US008286646B2

(12) United States Patent
Son et al.

(10) Patent No.: US 8,286,646 B2
(45) Date of Patent: Oct. 16, 2012

(54) COMPACT HAVING SLIDABLE IN AND OUT STRUCTURE OF CONTENT CASE

(75) Inventors: YoungHo Son, Seoul (KR); JuHo Kim, Anyang (KR); HakChan Kim, Gunpo (KR); YunHeui Lee, Seoul (KR); HoYoung Kim, Suwon (KR)

(73) Assignee: Amorepacific Corporation (KR)

( * ) Notice: Subject to any disclaimer, the term of this patent is extended or adjusted under 35 U.S.C. 154(b) by 882 days.

(21) Appl. No.: 11/576,563

(22) PCT Filed: Oct. 10, 2005

(86) PCT No.: PCT/KR2005/003353

§ 371 (c)(1),
(2), (4) Date: Apr. 3, 2007

(87) PCT Pub. No.: WO2006/080733

PCT Pub. Date: Aug. 3, 2006

(65) Prior Publication Data

US 2007/0261710 A1 Nov. 15, 2007

(30) Foreign Application Priority Data

| | | |
|---|---|---|
| Oct. 12, 2004 | (KR) | 20-2004-0028888 U |
| Jun. 1, 2005 | (KR) | 20-2005-0015650 U |
| Jun. 1, 2005 | (KR) | 20-2005-0015651 U |
| Jun. 1, 2005 | (KR) | 20-2005-0015652 U |
| Jun. 10, 2005 | (KR) | 20-2005-0016645 U |

(51) Int. Cl.
*A45D 33/20* (2006.01)

(52) U.S. Cl. ..... 132/287

(58) Field of Classification Search ..... 132/286–318; 206/235, 229, 581, 562, 823, 557, 386, 595–599, 206/555–556, 456, 493, 758, 762; 220/331, 220/811–81, 326, 8, 4.32, 534, 345.1, 345.2, 200/351, 345.4, 3, 815, 23.87–23.88; 312/9.3, 312/270.2–270.3, 270, 301, 323, 334.8, 300.1, 312/350

See application file for complete search history.

(56) References Cited

U.S. PATENT DOCUMENTS 1,247,848 A * 11/1917 List ..... 206/45.23

(Continued)

FOREIGN PATENT DOCUMENTS

EP 1 466 539 A1 10/2004

(Continued)

*Primary Examiner* — Todd Manahan
*Assistant Examiner* — Brianne Kalach
(74) *Attorney, Agent, or Firm* — John K. Park; Park Law Firm

(57) ABSTRACT

The present invention relates to a compact container where a content case can be inserted into and ejected from a side of an external case with sliding, more particularly, to a compact container where a content case is easily opened and closed by drawing it from an external case in a sliding manner, user can look at her face in a mirror attached to the top side of the external case, needless to open a cover of a compact container or take a separate mirror with herself, and further user can easily makeup her face looking at the mirror attached on the top side of the external case, which is set to stand with an amount of angle with respect to the content case after the content case drew to open. The compact container includes a content case for containing the makeup materials having guide grooves on its both sides; and an external case with an opened side where the content case is inserted into and ejected out in a sliding manner, wherein, the external case is set to stand with a predetermined angle with respect to the content case after the content case is ejected from the external case.

2 Claims, 26 Drawing Sheets

U.S. PATENT DOCUMENTS 4,037,940 A * 7/1977 Yates et al. ..... 359/672
4,388,935 A 6/1983 Napolitane
4,898,195 A * 2/1990 Sussman ..... 132/317
5,054,505 A * 10/1991 Yuhara ..... 132/294
5,163,457 A * 11/1992 Lombardi, Jr. ..... 132/304
5,353,947 A * 10/1994 Zinnbauer et al. ..... 220/812
6,363,947 B1 4/2002 Wu

FOREIGN PATENT DOCUMENTS

JP 2005-046626 A 2/2005

* cited by examiner

[Fig. 1]
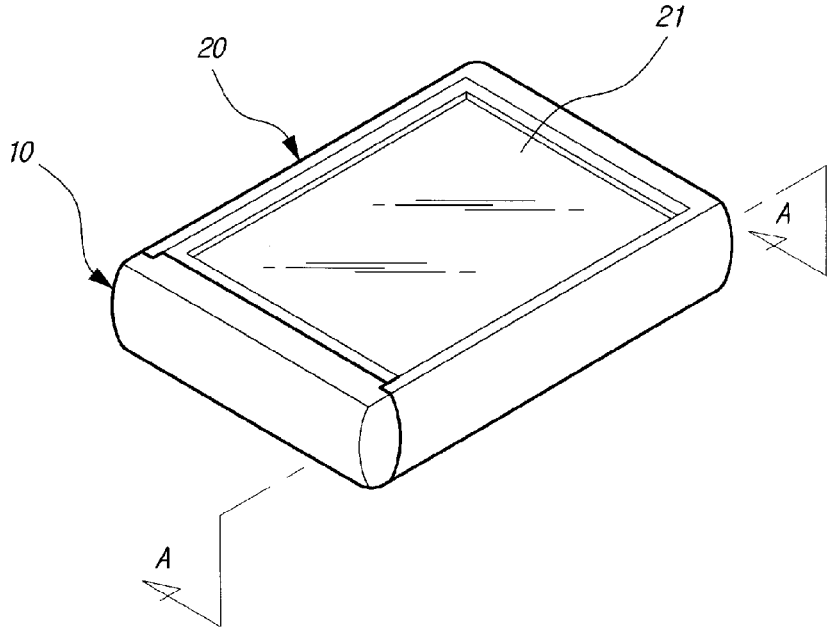
[Fig. 2]
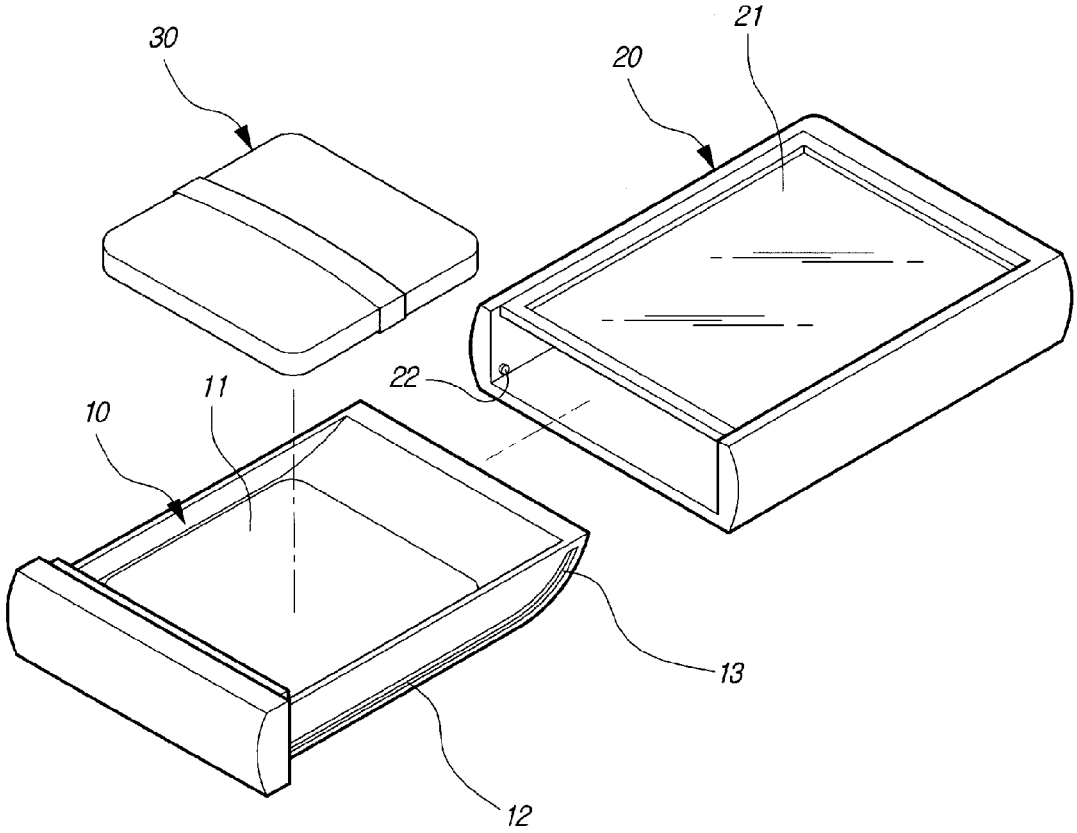

[Fig. 3]
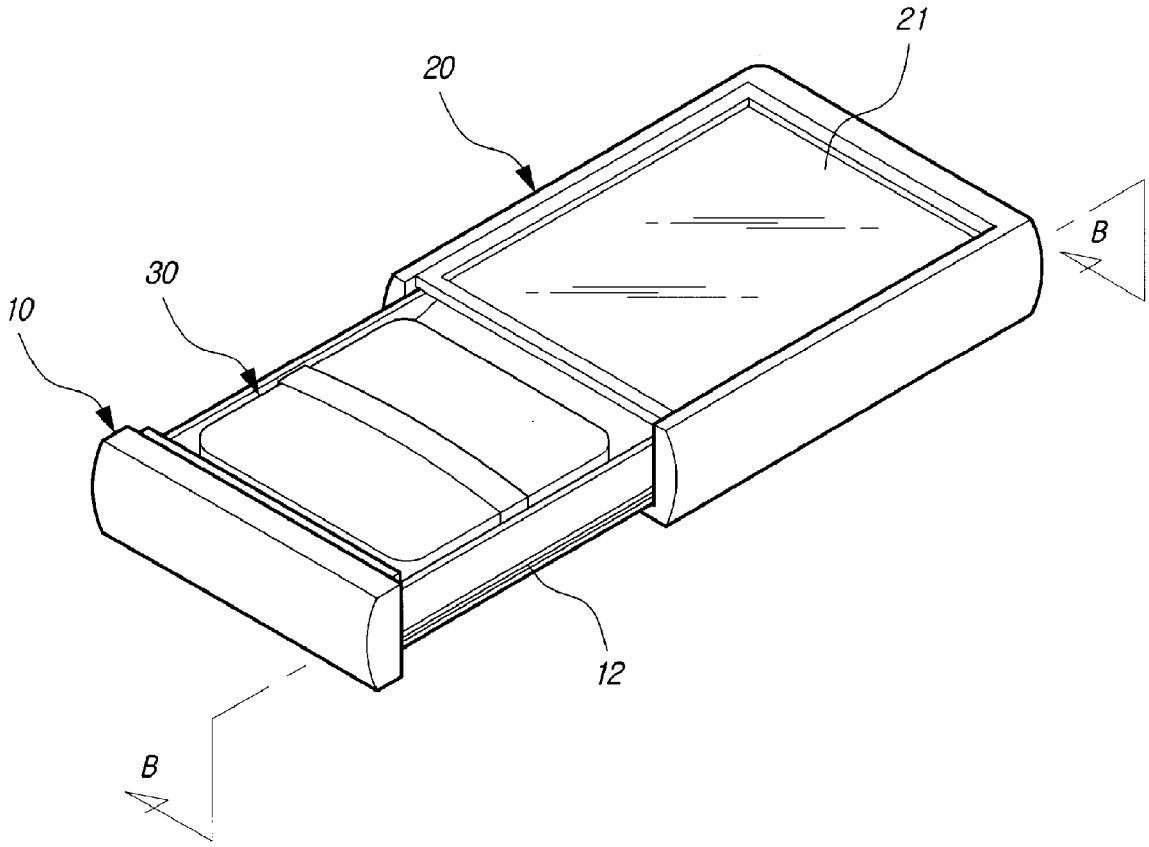

[Fig. 4]
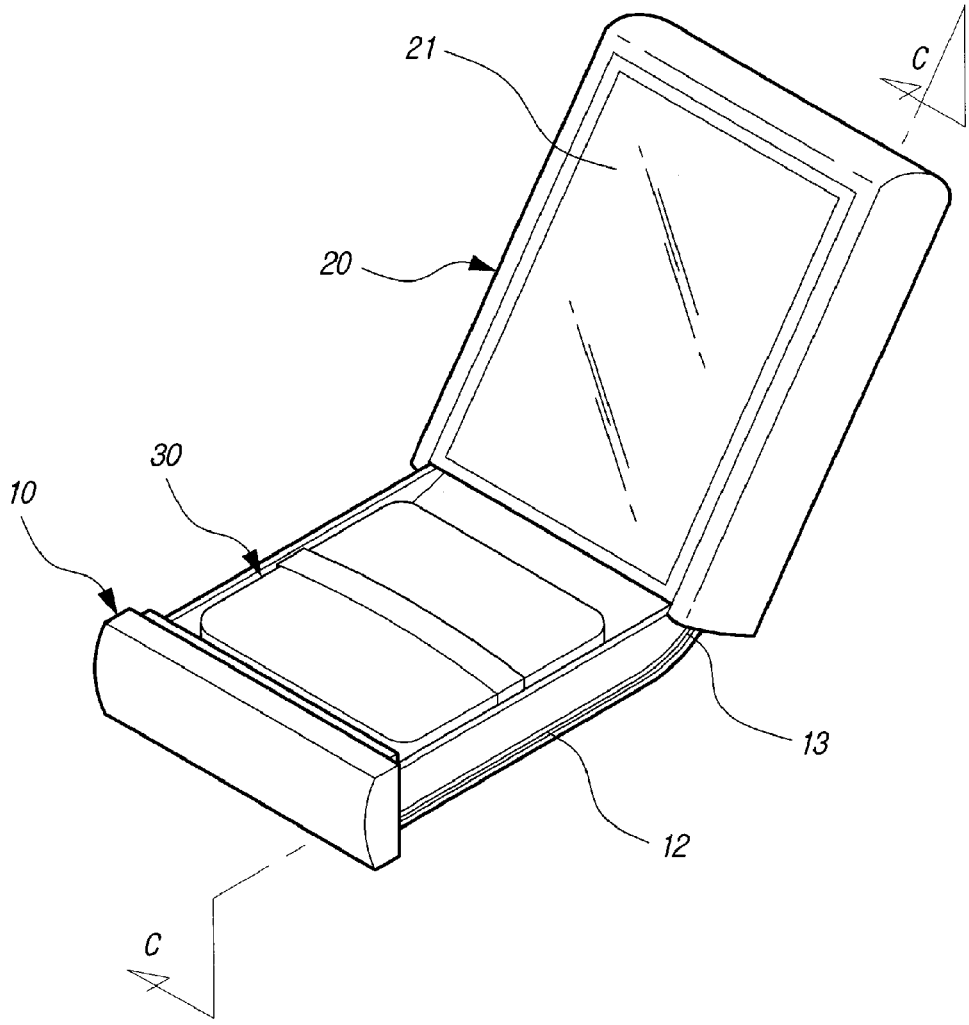
[Fig. 5]
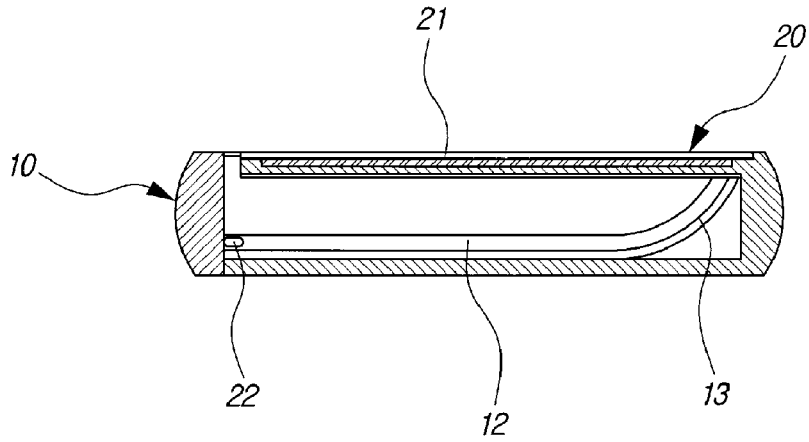

[Fig. 6]
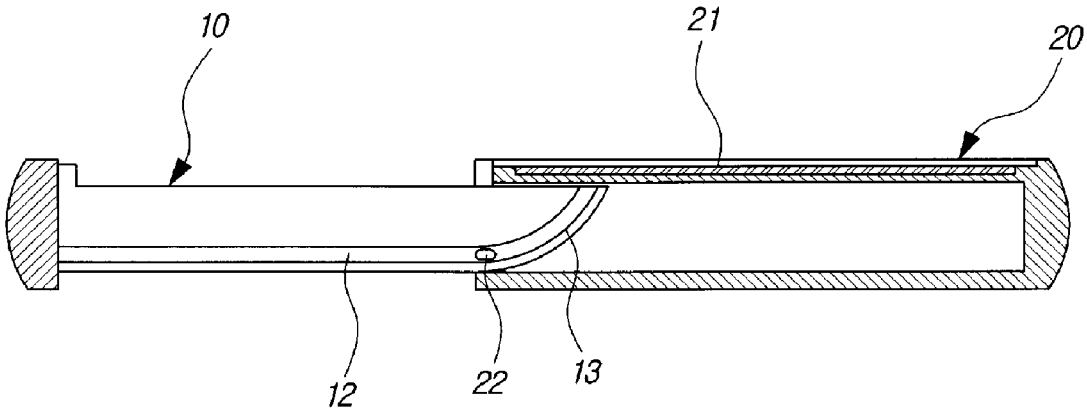
[Fig. 7]
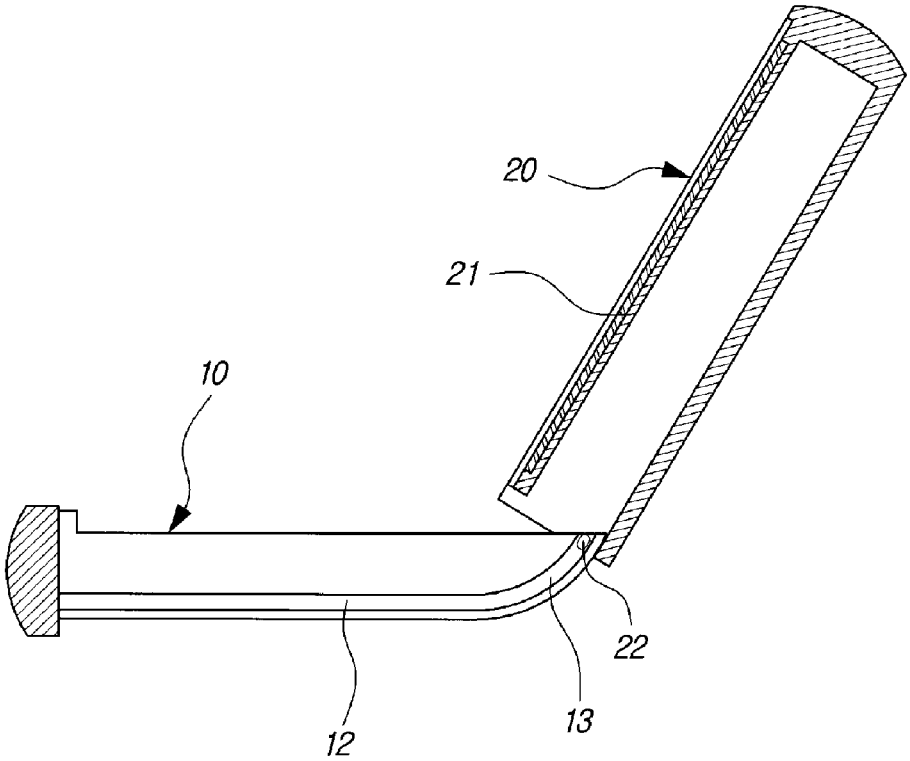

[Fig. 8]
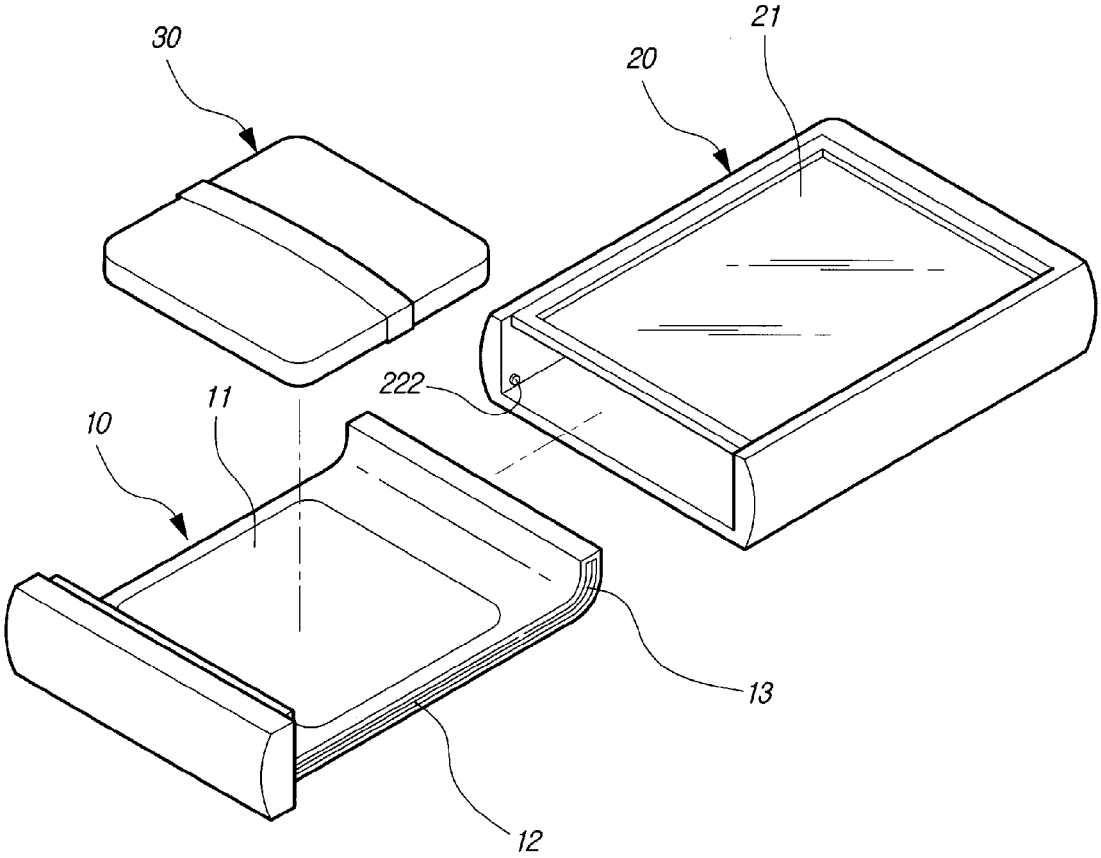
[Fig. 9]
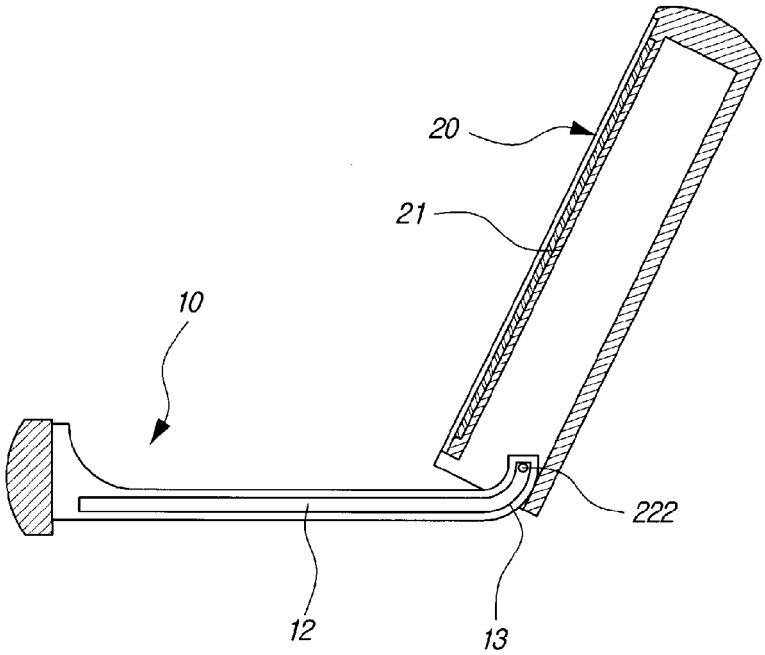

[Fig. 10]
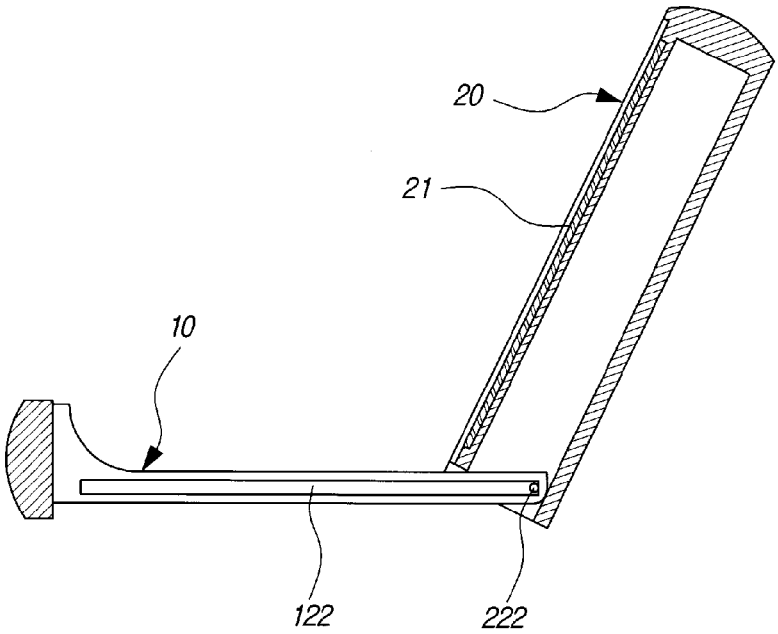
[Fig. 11]
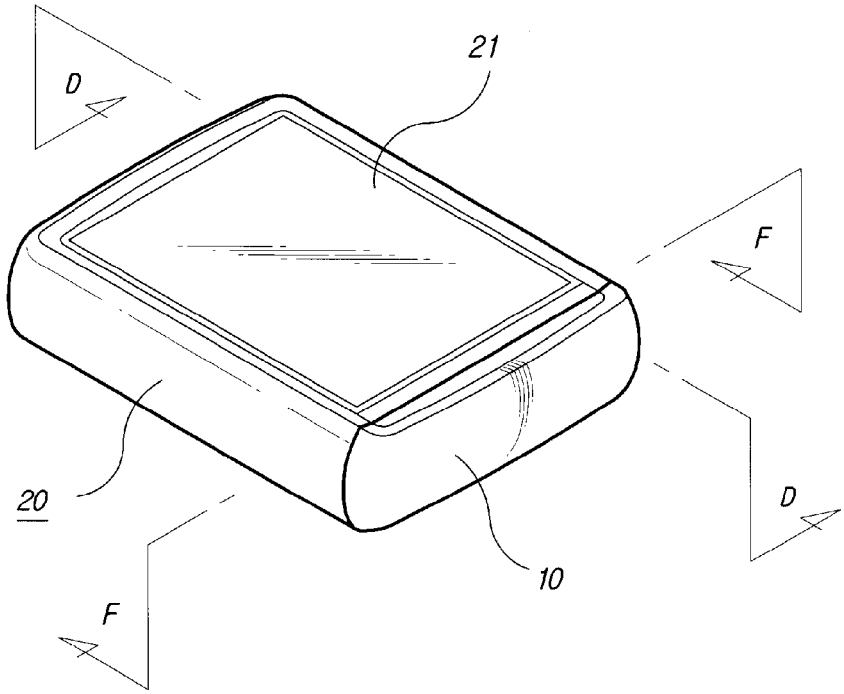

[Fig. 12]
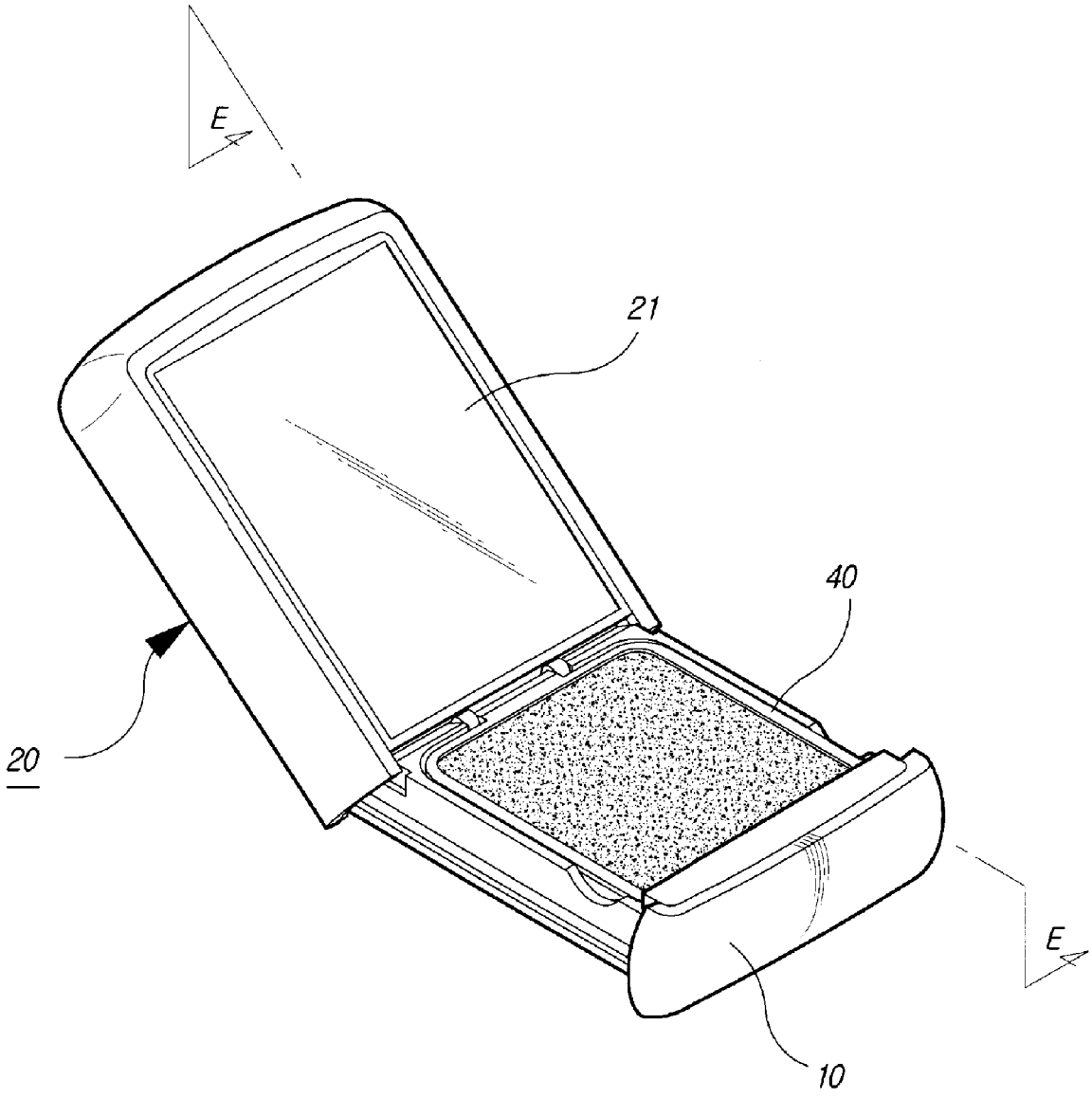

[Fig. 13]
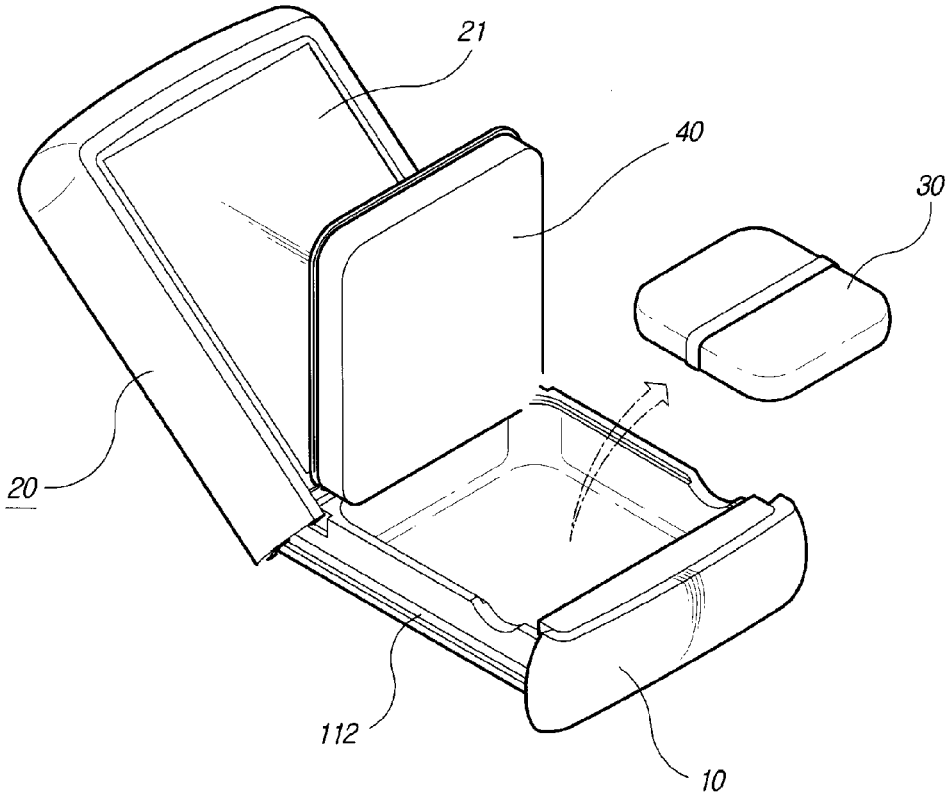
[Fig. 14]
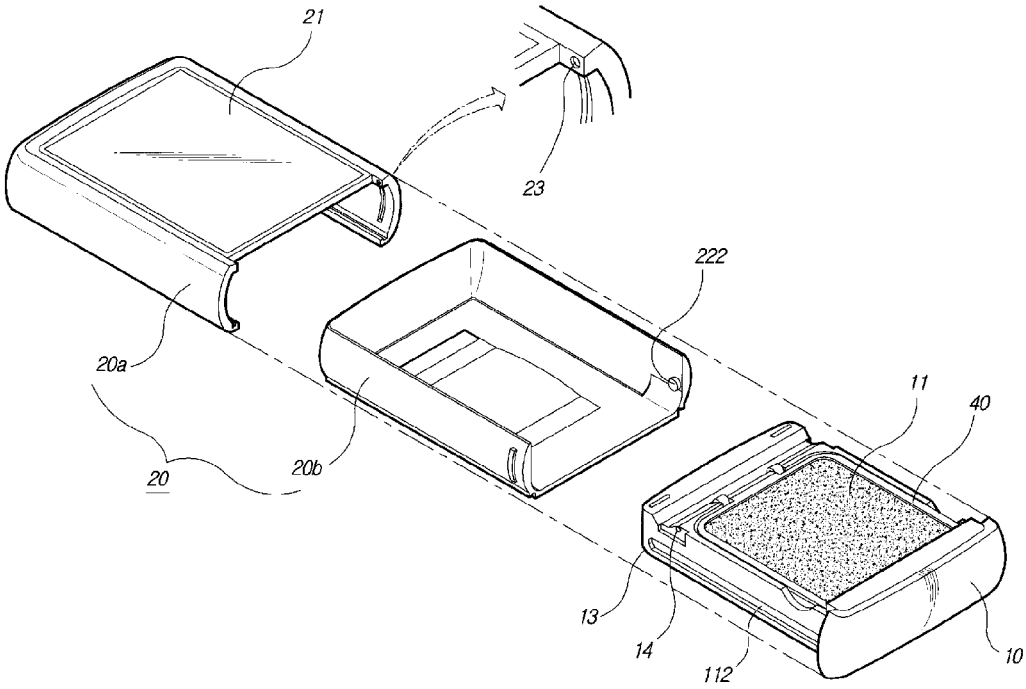

[Fig. 15]
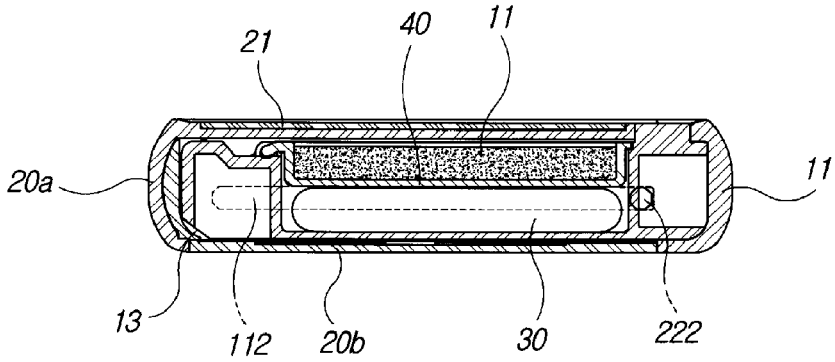
[Fig. 16]
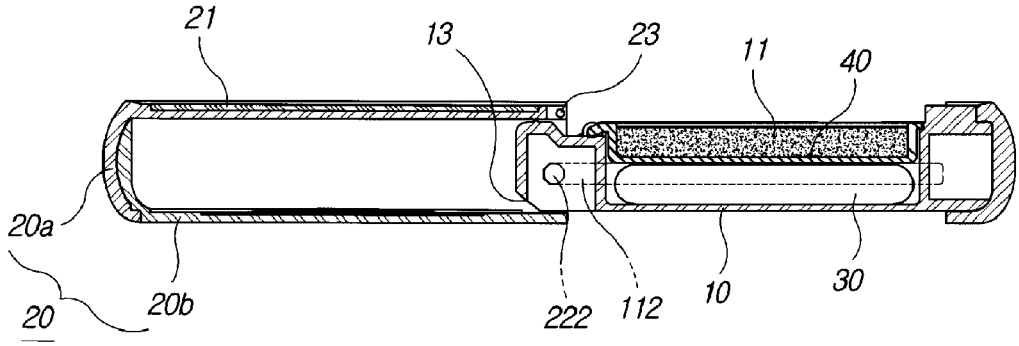
[Fig. 17]
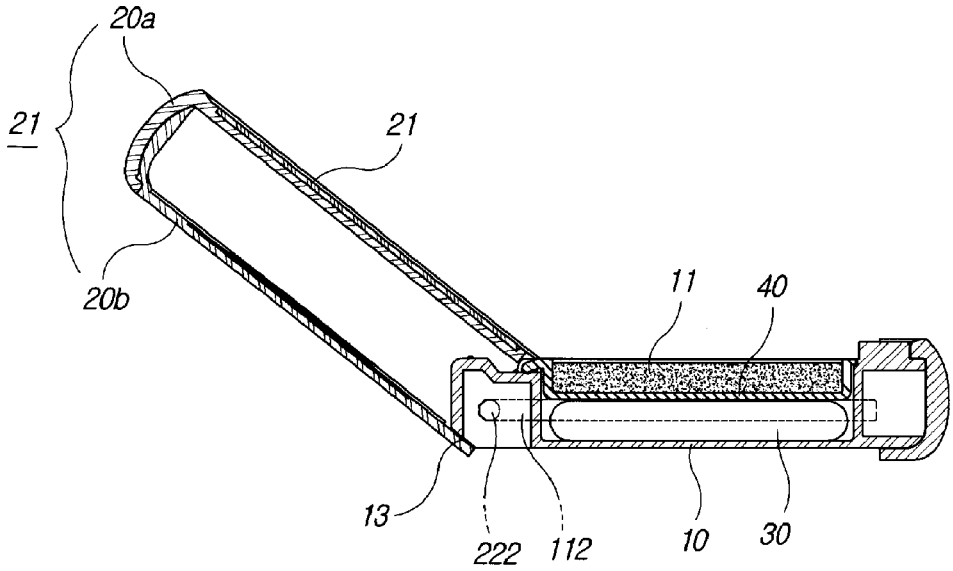

[Fig. 18]
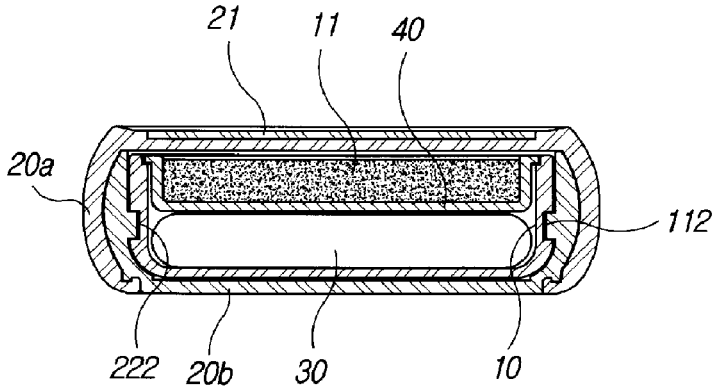
[Fig. 19]
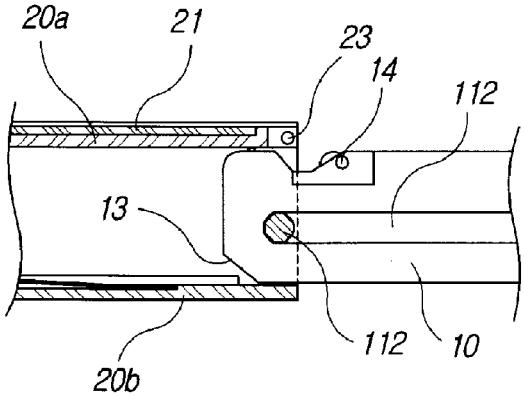
[Fig. 20]
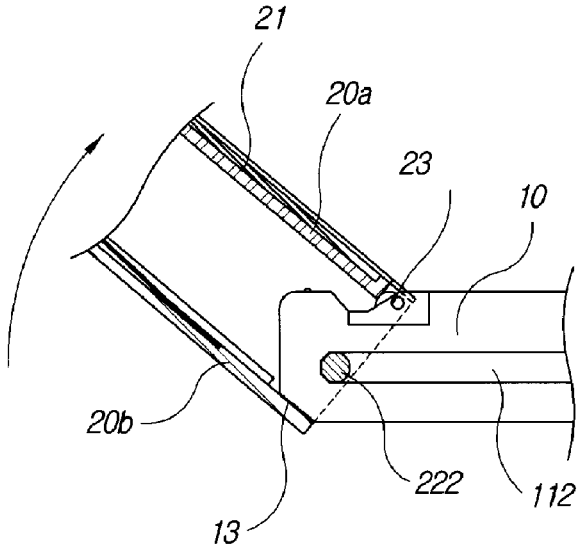

[Fig. 21]
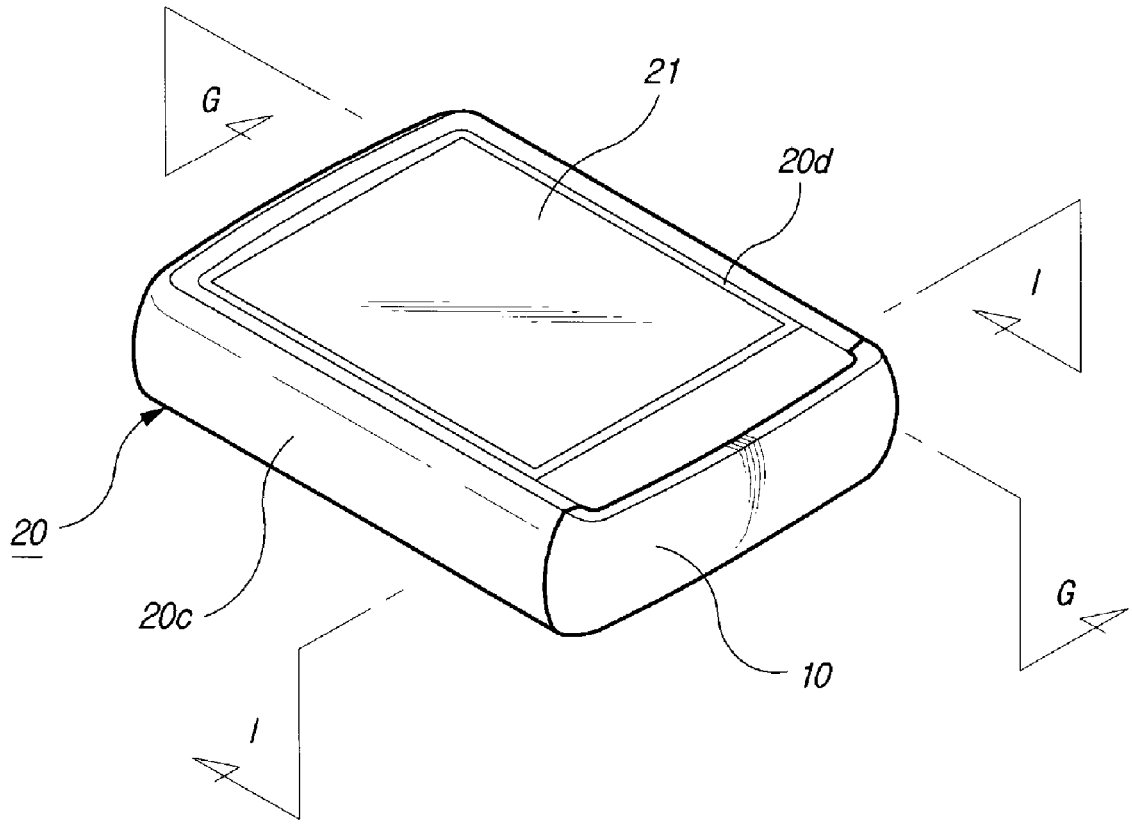

[Fig. 22]
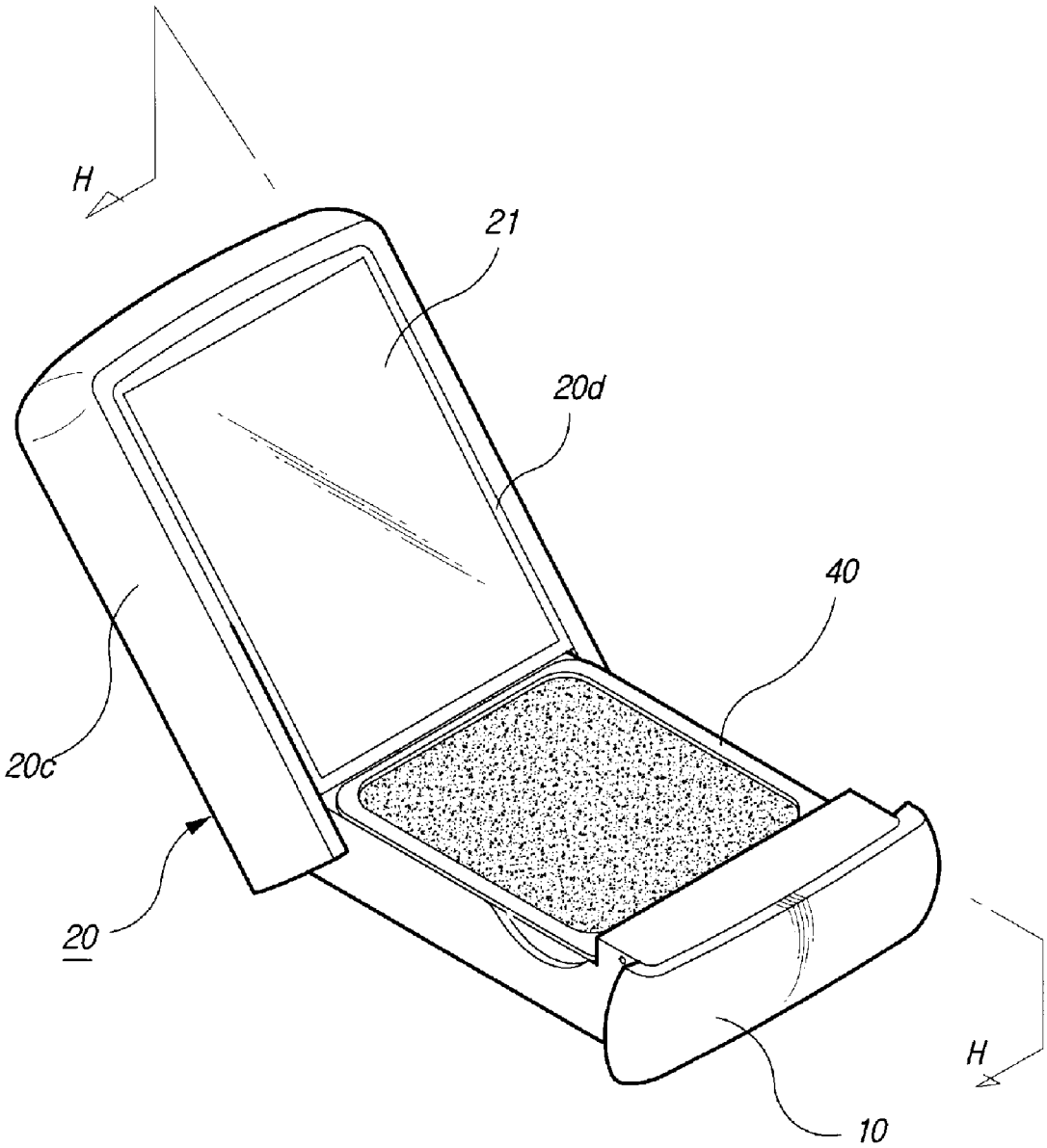

[Fig. 23]
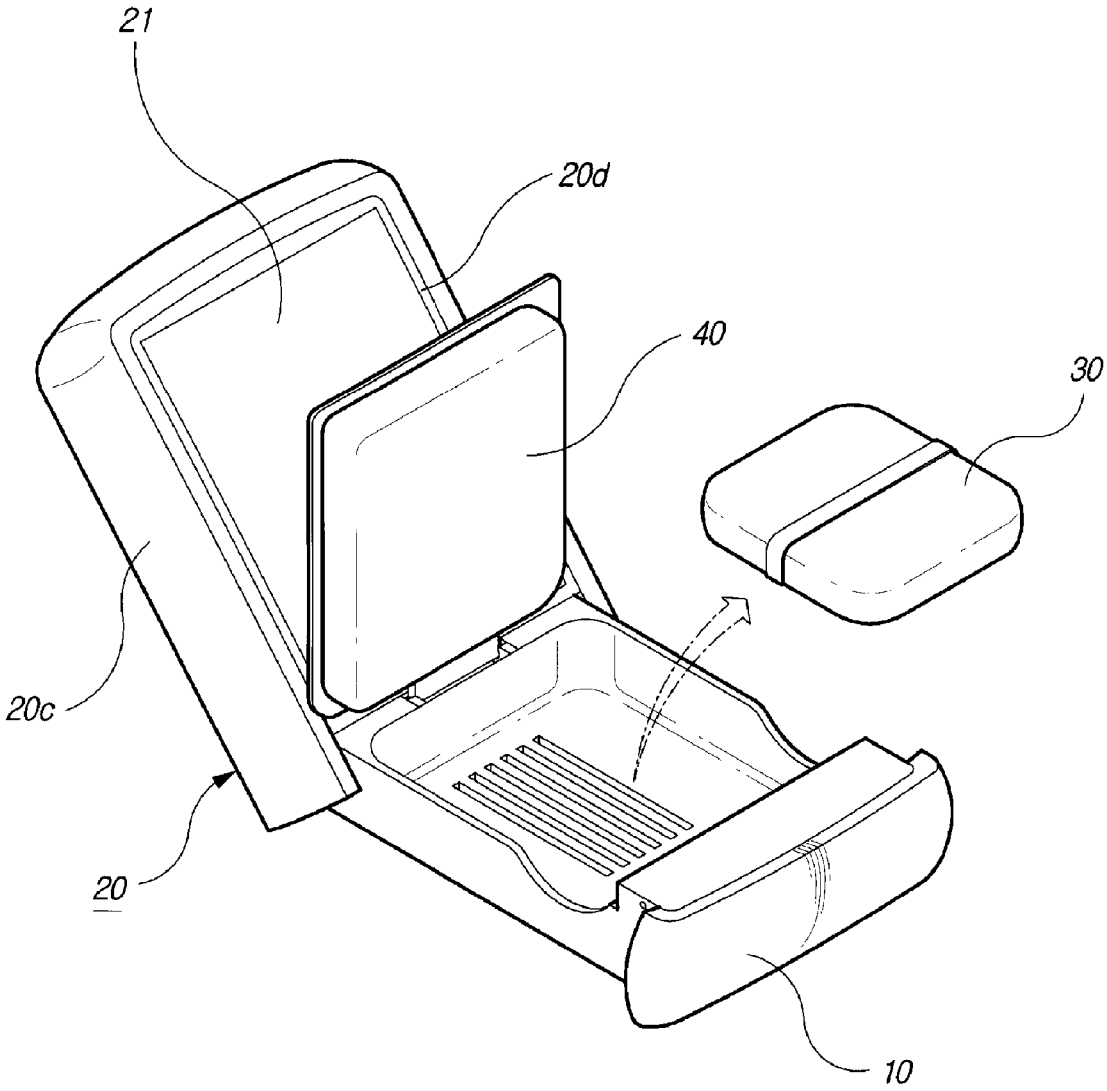

[Fig. 24]
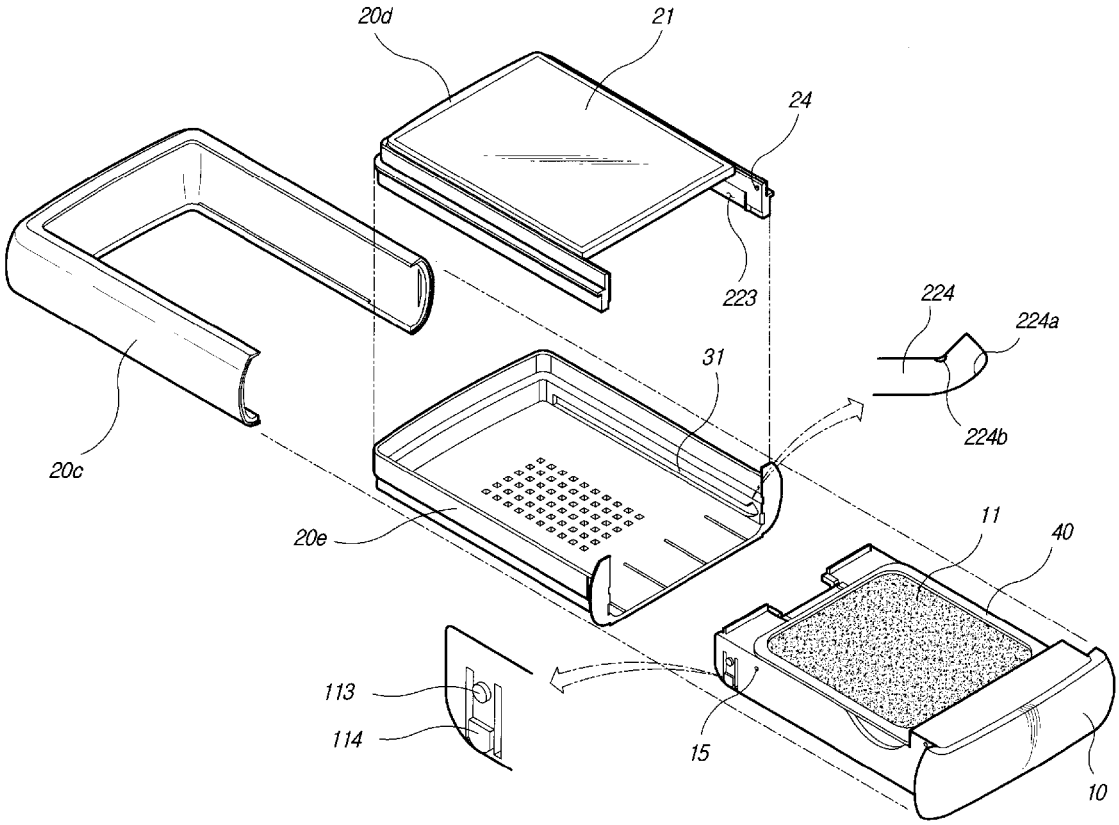
[Fig. 25]
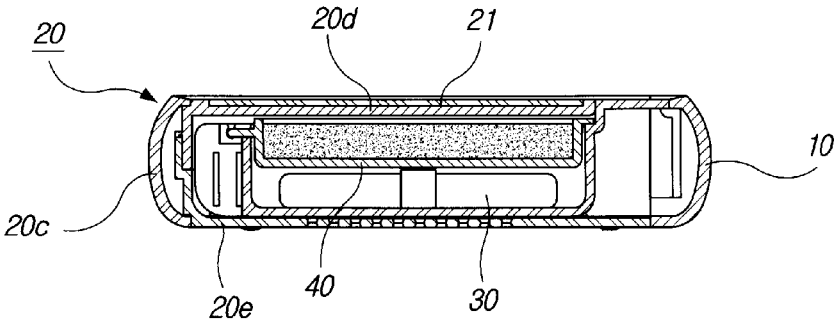

[Fig. 26]
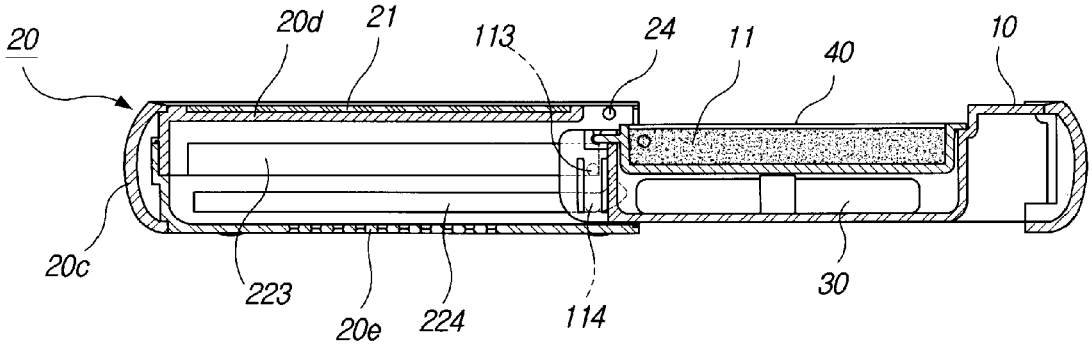
[Fig. 27]
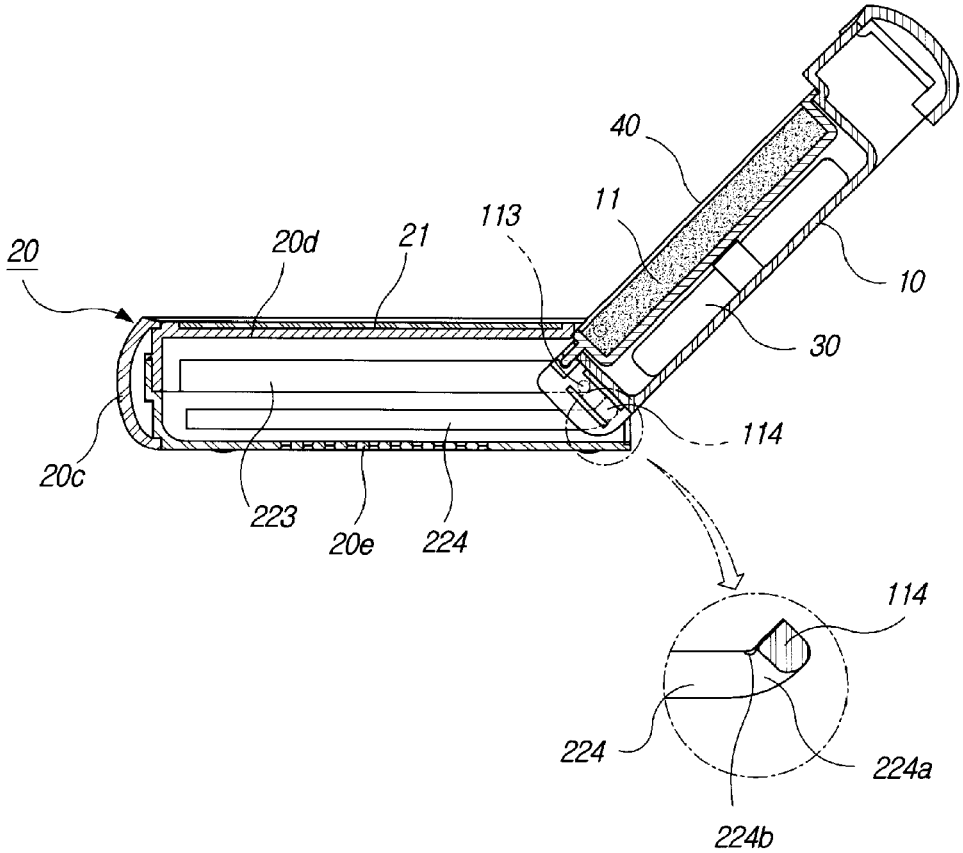

[Fig. 28]
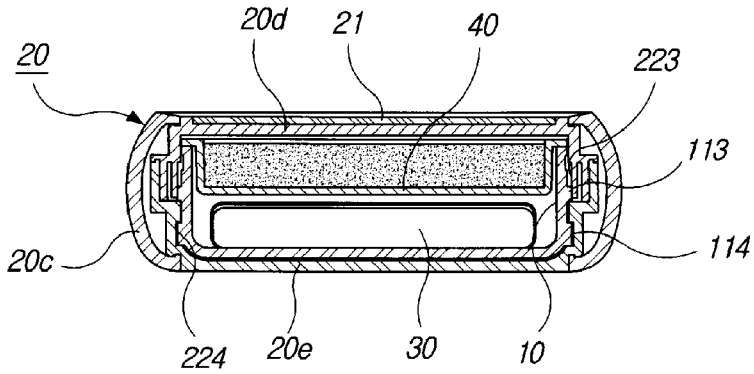
[Fig. 29]
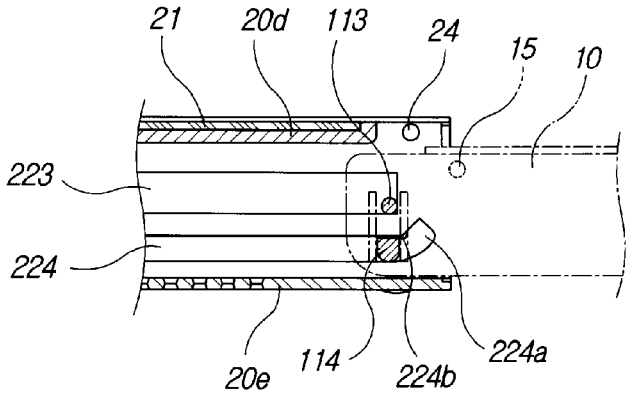
[Fig. 30]
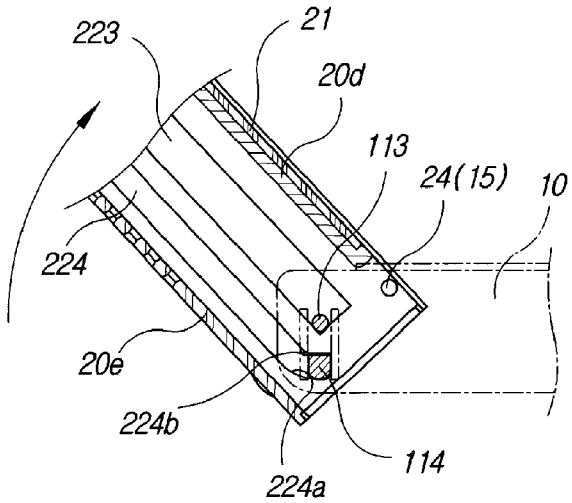

[Fig. 31]
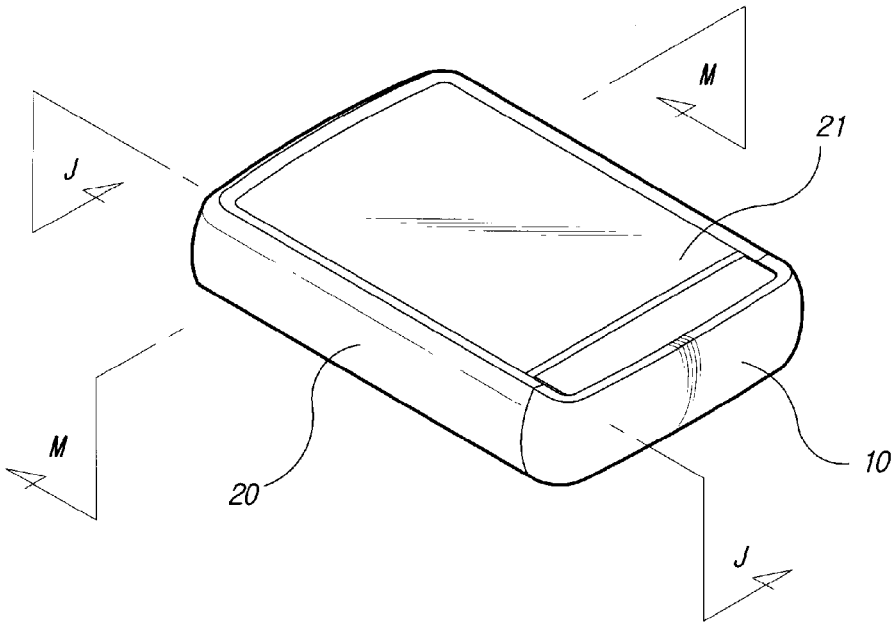
[Fig. 32]
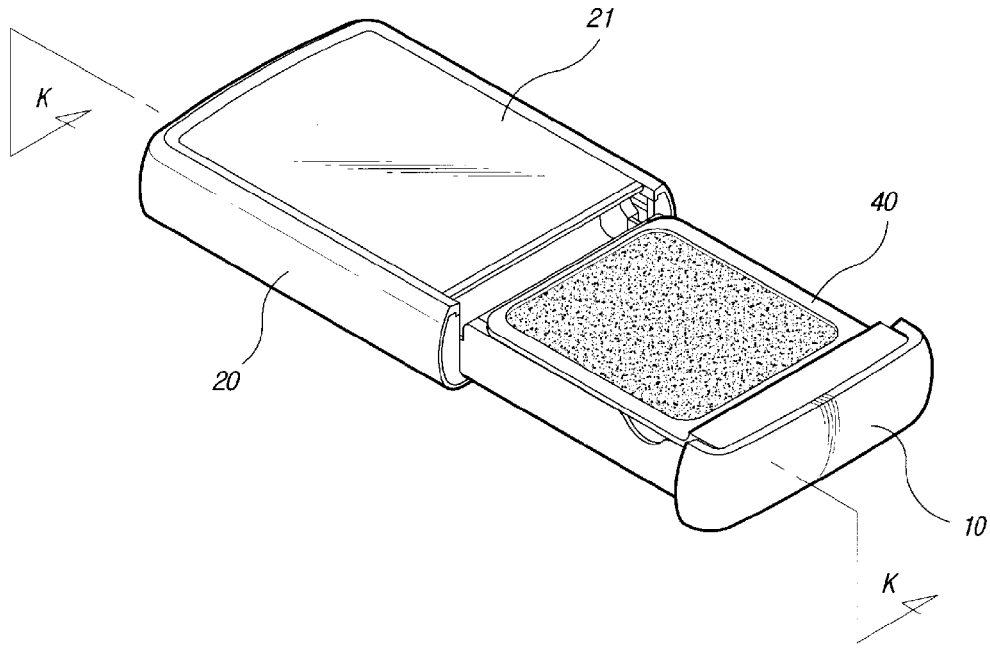

[Fig. 33]
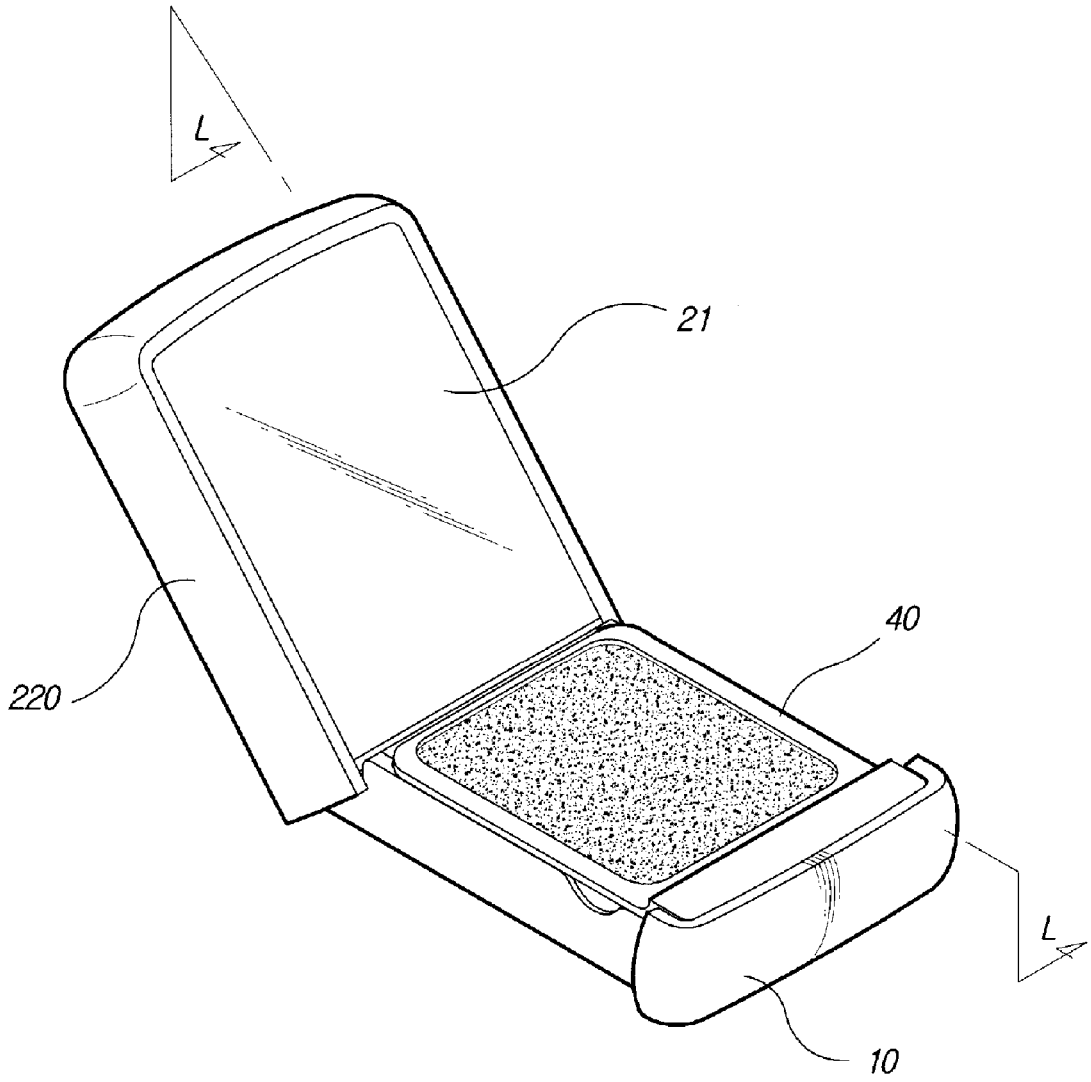

[Fig. 34]
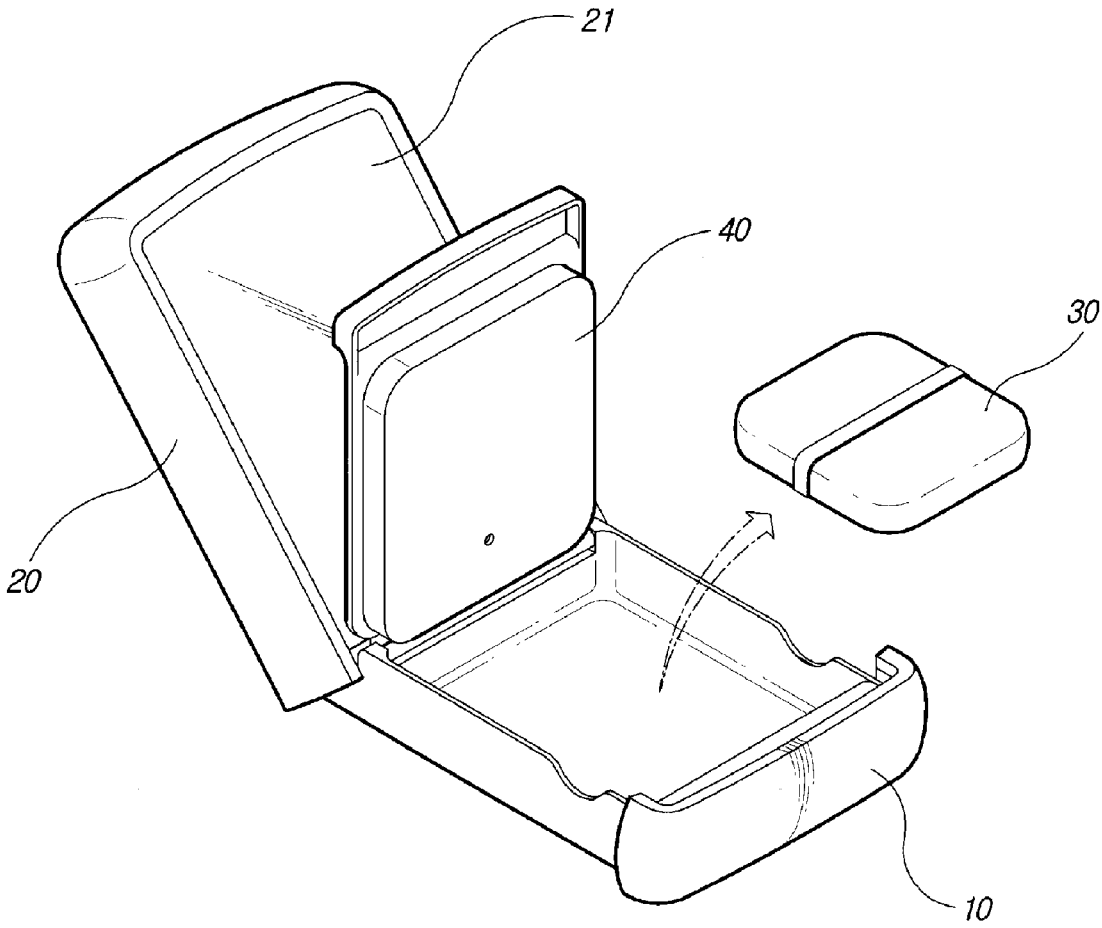

[Fig. 35]
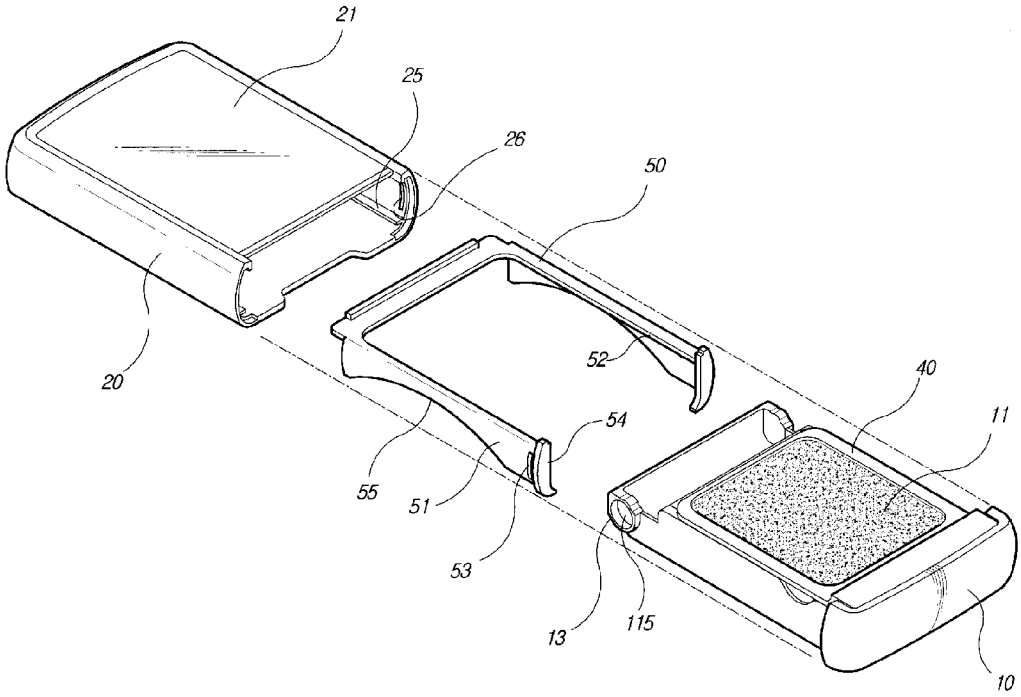
[Fig. 36]
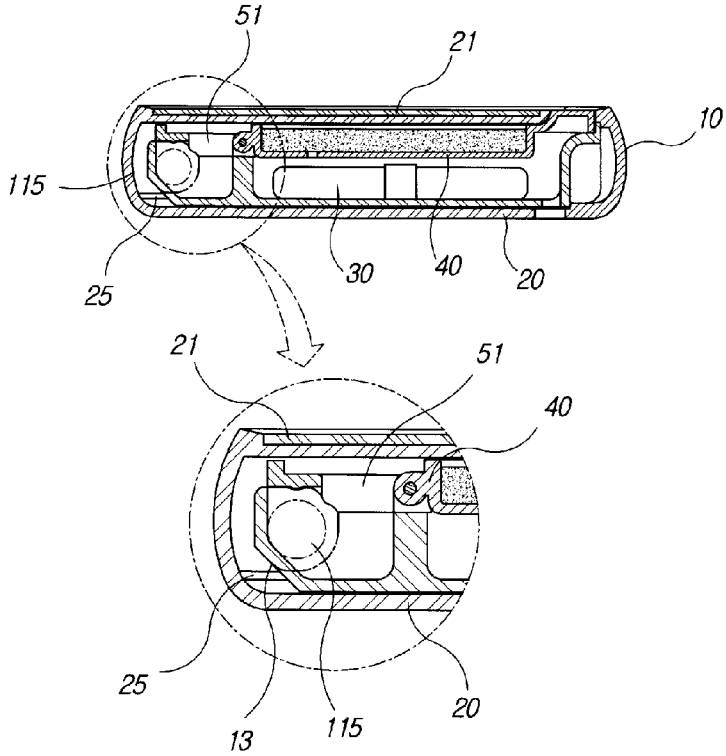

[Fig. 37]
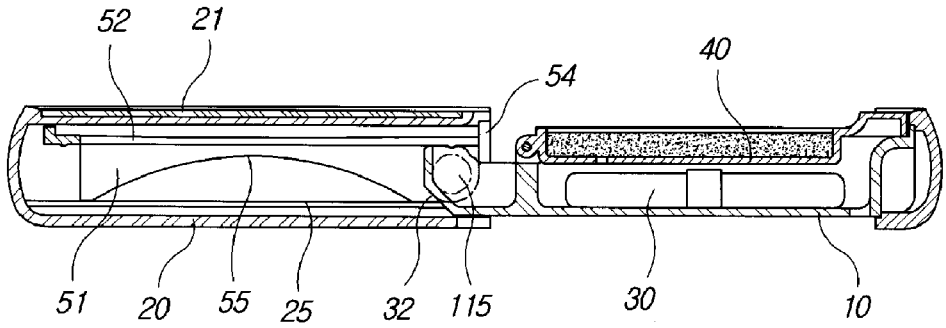
[Fig. 38]
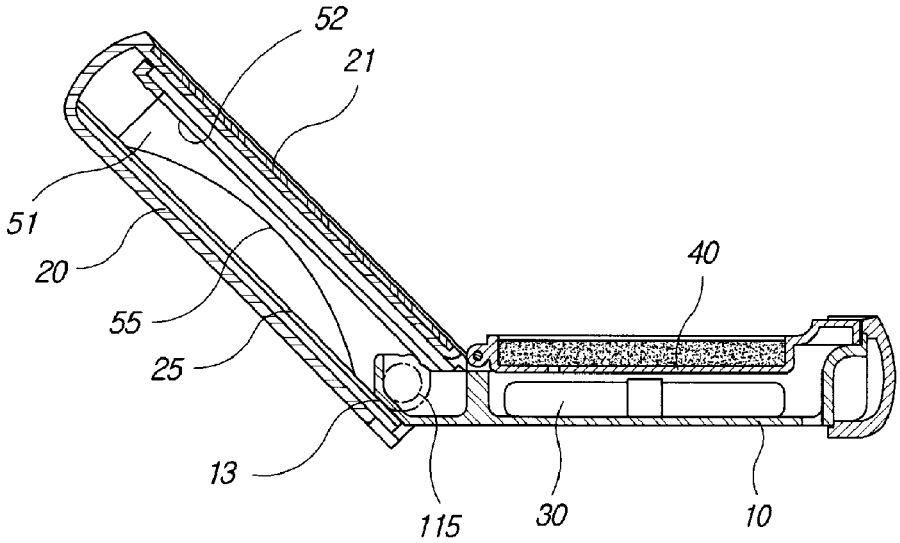
[Fig. 39]
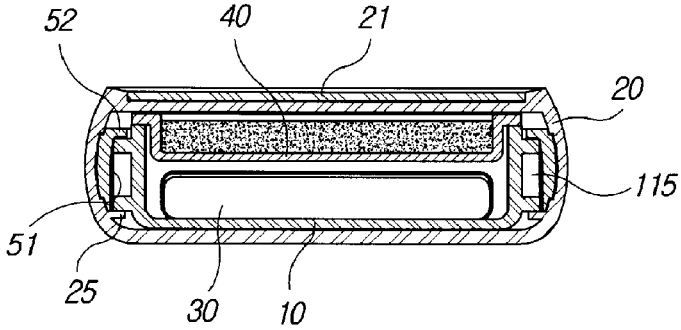

[Fig. 40]
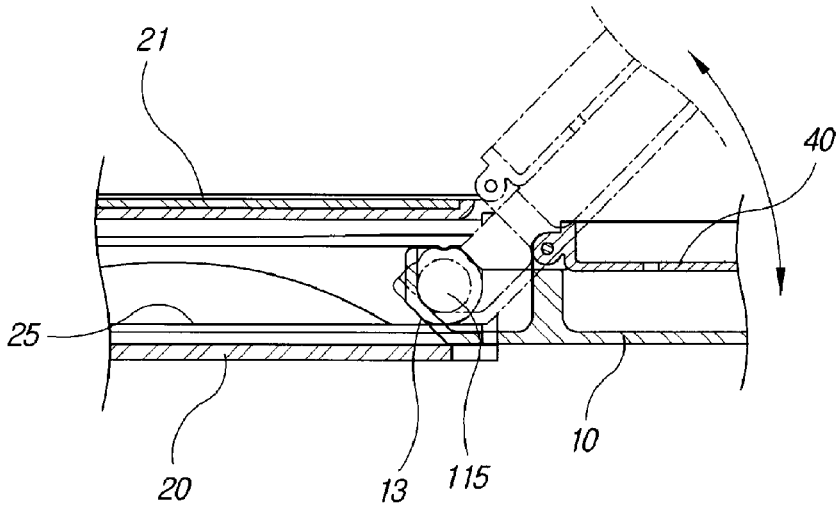
[Fig. 41]
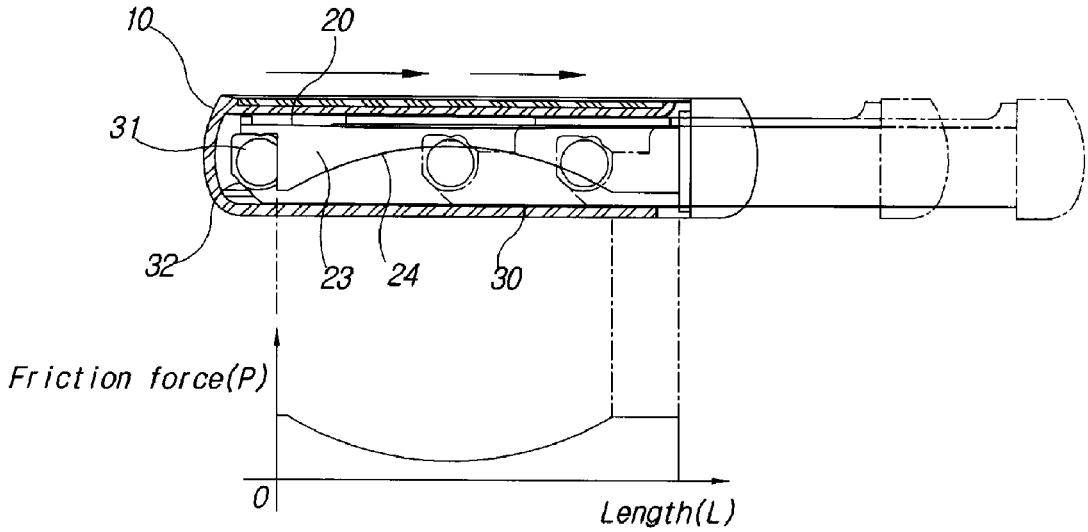

[Fig. 42]
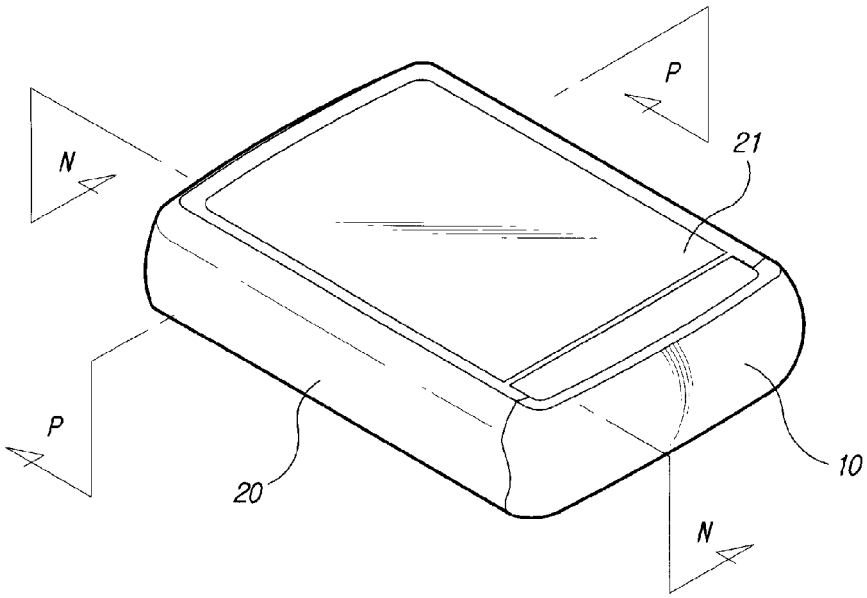
[Fig. 43]
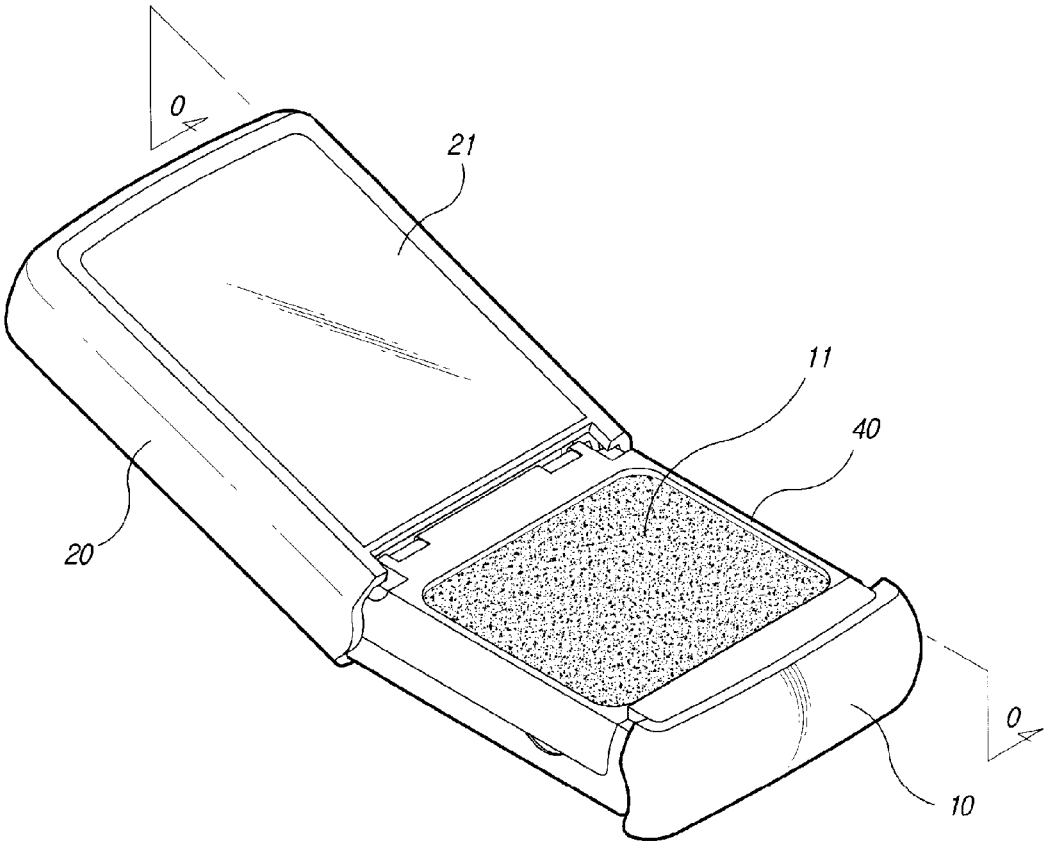

[Fig. 44]
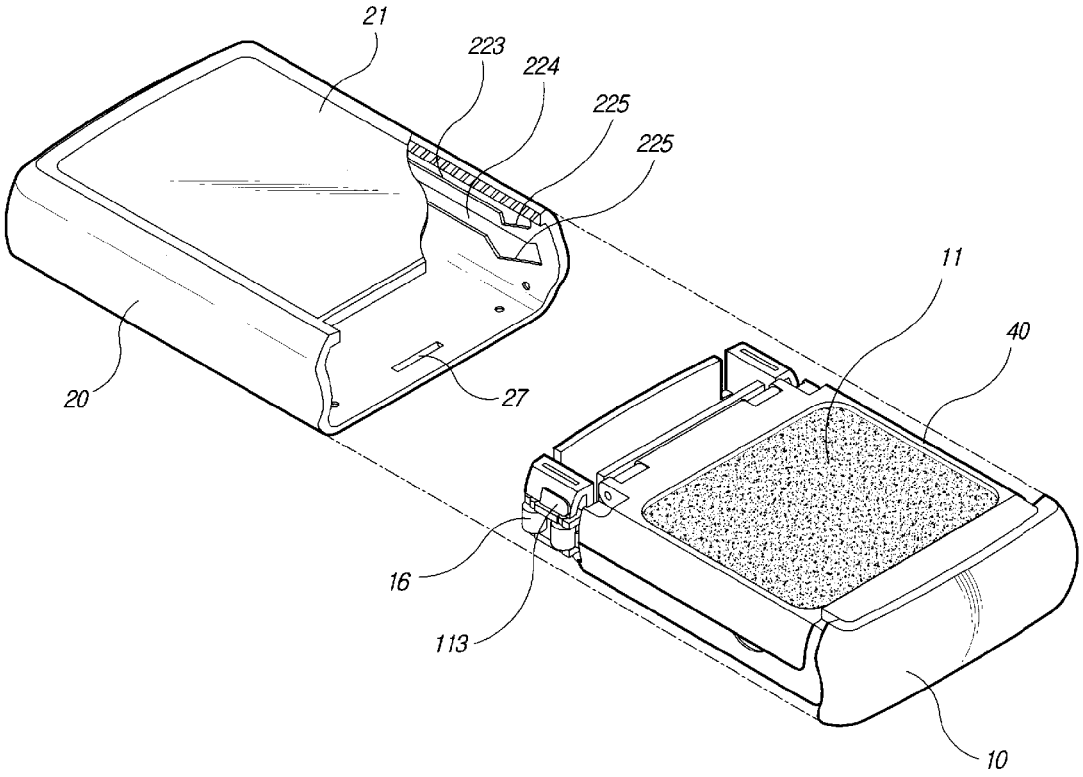
[Fig. 45]
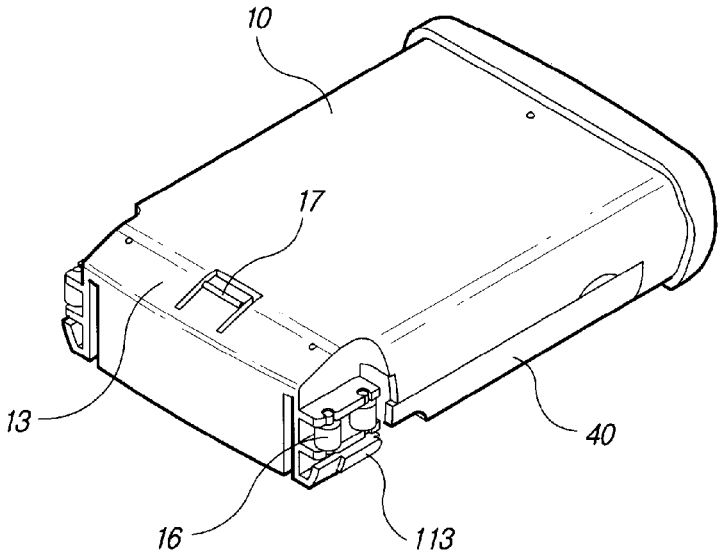

[Fig. 46]
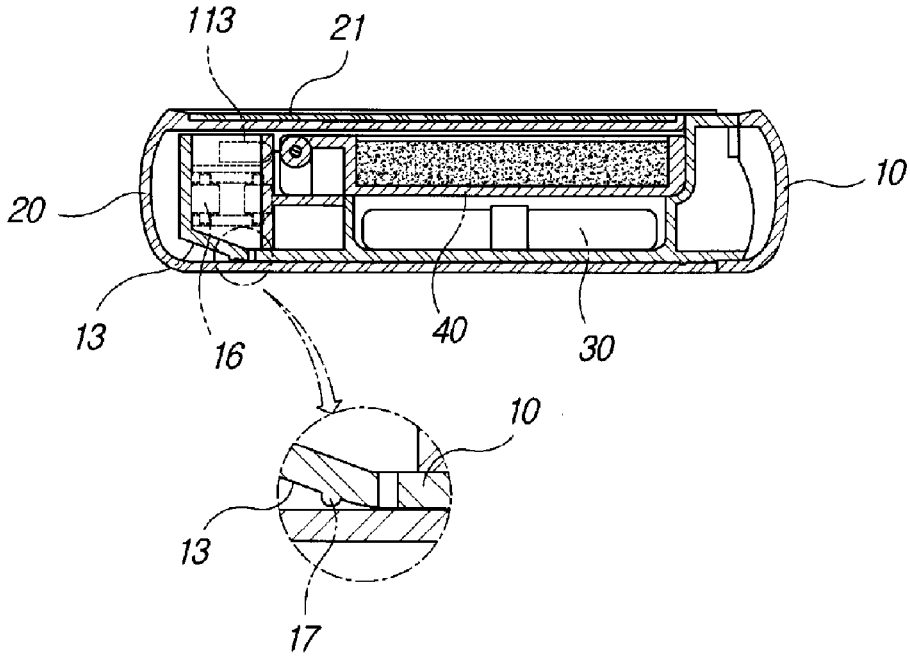
[Fig. 47]
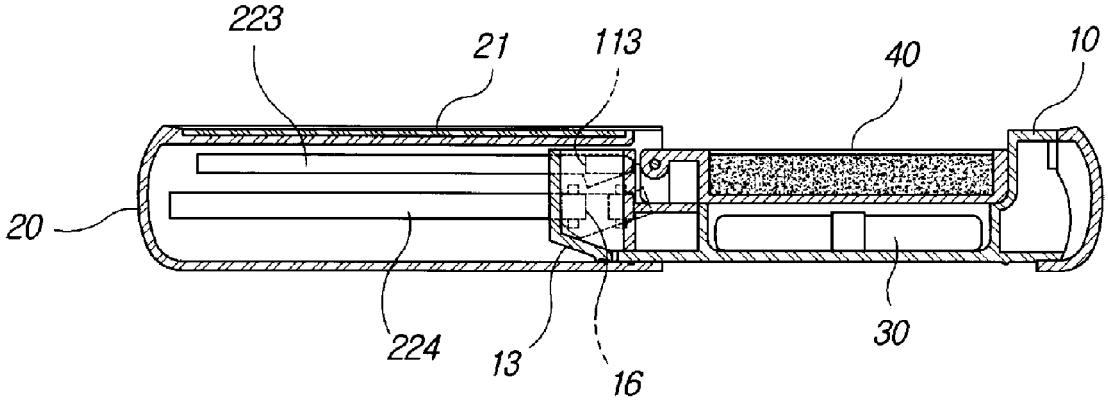

[Fig. 48]
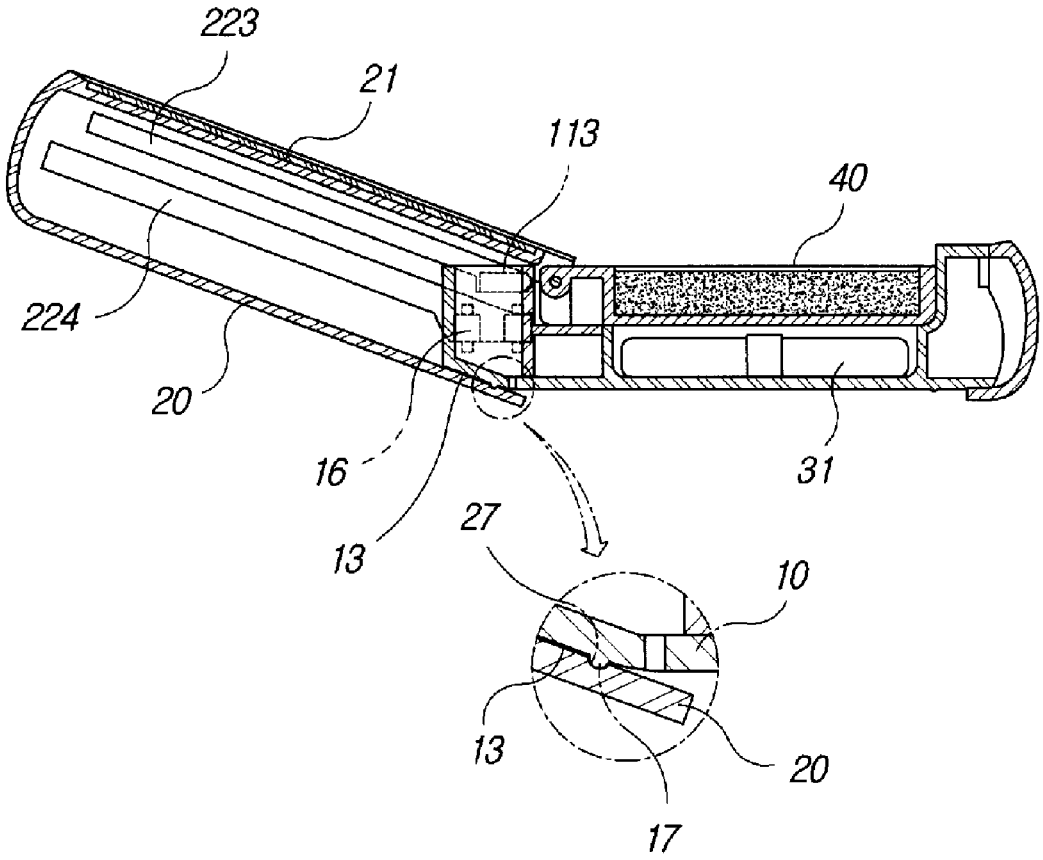
[Fig. 49]
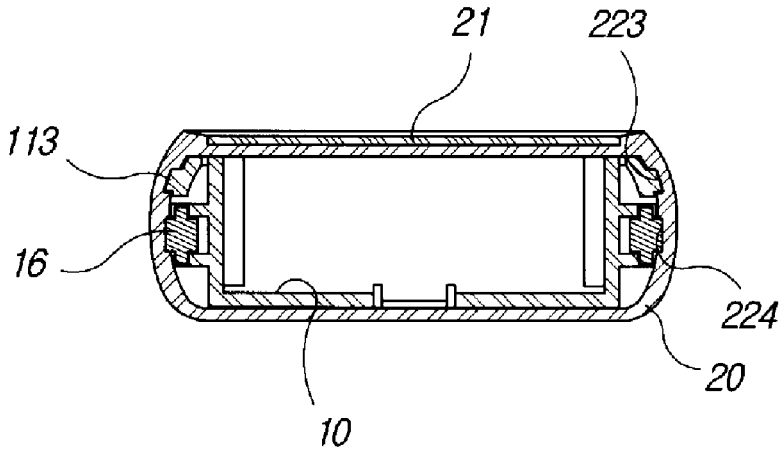

COMPACT HAVING SLIDABLE IN AND OUT STRUCTURE OF CONTENT CASE

TECHNICAL FIELD

The present invention relates to a compact container where a content case can be inserted into and ejected from a side of an external case in a sliding manner, more particularly, to a compact container where a content case is easily opened and closed by drawing it from an external case in a sliding manner, user can look at her face in a mirror attached to the top side of the external case, needless to open a cover of a compact container or take a separate mirror with herself, and further user can easily makeup her face looking at the mirror attached on the top side of the external case, which is set to stand with an amount of angle with respect to the content case after the content case drew to open.

Further, the present invention relates to a compact container providing more stable sense of utility while being handy and superior by improving a sliding structure, a hinging structure and an unfolded angle fixing structure of the content case and the external case. Still further, the present invention relates to a compact container maximizing effect of yielding economical profit by providing a smooth sense of usage with women who are major client when opening and closing the drawer-type content case.

BACKGROUND ART

A mirror is attached to an inner side of a cover of a compact container such as a compact, an eye shadow, etc. generally. When intending to makeup, user looks at her face in the mirror with the cover opened. At that time, user puts on her face with a puff in one hand while holding the compact container in the other hand. However, there is inconvenience when woman intends to use only a mirror, not to put on her face, because she must open the cover of the compact container or because she should take a separate mirror with herself. The compact container such as a compact, an eyeshadow, etc. is produced by hinge-connecting each sides of two separate cases having a mirror, makeup materials, a puff, etc. contained into the cases respectively. Such a compact container has been produced in a same structure up to now since those had been developed. Although compact containers having various shapes and designs have been come forward into the market so as to satisfy desires of various consumers with unique individuality, consumers easily get tired with them because they merely have tried to satisfy desires of consumers through limited transformation of its external case in a shape or color.

DISCLOSURE OF INVENTION

Technical Problem

An object of the present invention is to provide a compact container with a mirror attached outside by which user can look at her face needless to open a cover of a compact container or needless to take a separate mirror with herself. Another object of the present invention is to provide a compact container having a sliding inserting/ejecting structure of a container case where the content case is easily opened and closed by drawing it from an external case in a sliding manner and the external case is set to stand with an amount of angle with respect to the container case. Still another object of the present invention is to provide a compact container allowing more convenient makeup by improving a sliding structure, a hinging structure and an unfolded angle fixing structure of the content case and the external case in order that the content case can be operated smoothly in a sliding inserting/ejecting operation while the external case is set to stand with an amount of angle with respect to the container case having been drew.

Technical Solution

A compact container according to a preferred embodiment of the present invention includes a content case for containing makeup materials having guide grooves formed on its both sides; and an external case with an opened side for inserting and ejecting the content case in a sliding manner having guide projections which are fitted the guide grooves together and formed on its both inner sides.

It is preferable that the compact container further includes an inserting/ejecting means for inserting/ejecting the content case from the external case in a sliding manner; an angle fixing means for fixing the content ejected with an amount of angle; and a friction means for inserting/ejecting the content case rhythmically and smoothly.

Advantageous Effects

The compact container with the sliding inserting/ejecting structure according to the present invention is very useful in that a user can put on her face in any time while looking at her face without any need to take a separate mirror with herself since the mirror is attach is to the external surface, it is handy since the user can easily draw out the content case in a sliding manner, the user can put on her face, looking at her face in the mirror attached to the top side of the external case, as like using a makeup stand since the external case is set to stand with an amount of angle with respect to the content case. Further the compact container according to the present invention is useful in that it can provide a smooth sense of usage since the content case can ejected smoothly without fluctuating by guide grooves, guide rails, guide projections and guide rollers, and the user can put on her face stably and comfortably since the external case is set to stand with an amount of angle with respect to the content case by padding units and fixing devices in the bottom ends of the content case.

BRIEF DESCRIPTION OF THE DRAWINGS

The above and other features and advantages of the present invention will become more apparent by describing in detail exemplary embodiments thereof with reference to the attached drawings in which:

FIG. 1 illustrates a perspective view of a compact container according to an embodiment of the present invention;

FIG. 2 illustrates an exploded perspective view of the compact container shown in FIG. 1;

FIGS. 3 and 4 illustrates a working state of the compact container;

FIG. 5 illustrates a sectional view along A-A line shown in FIG. 1;

FIG. 6 illustrates a sectional view along B-B line shown in FIG. 3;

FIG. 7 illustrates a sectional view along C-C line shown in FIG. 4;

FIG. 8 illustrates an exploded perspective view of a compact container according to another embodiment of the present invention;

FIG. 9 illustrates a sectional view showing a working state of the compact container shown in FIG. 8;

FIG. 10 illustrates a sectional view showing a working state of the compact container according to still another embodiment of the present invention;

FIG. 11 illustrates a perspective view of the present invention according still another embodiment of the present invention;

FIGS. 12 and 13 illustrates a working state of the compact container shown in FIG. 11;

FIG. 14 illustrates an exploded perspective view of the compact container shown in FIG. 11;

FIG. 15 illustrates a sectional view along D-D line shown in FIG. 11;

FIG. 16 illustrates a developed view of FIG. 15;

FIG. 17 illustrates a sectional view along E-E line shown in FIG. 12;

FIG. 18 illustrates a sectional view along F-F line shown in FIG. 11;

FIGS. 19 and 20 illustrates an operational view of an angle-fixing unit of the compact container shown in FIG. 11;

FIG. 19 illustrates an enlarged view of a principal part when horizontally ejected;

FIG. 20 illustrates an enlarged sectional view when angle-fixed according to the rotation of the content case;

FIG. 21 illustrates a perspective view of a compact container according to still another embodiment of the present invention;

FIGS. 22 and 23 illustrate showing a working state of the compact container shown in FIG. 21;

FIG. 24 illustrates an exploded perspective view of the compact container shown in FIG. 21;

FIG. 25 illustrates a sectional view along G-G line shown in FIG. 21;

FIG. 26 illustrates a developed sectional view of FIG. 25;

FIG. 27 illustrates a sectional view along H-H line shown in FIG. 22;

FIG. 28 illustrates a sectional view along I-I line shown in FIG. 21;

FIGS. 29 and 30 illustrates an operational view of an angle-fixing unit of the compact container shown in FIG. 21;

FIG. 29 illustrates an enlarged view of a principal part when horizontally ejected;

FIG. 30 illustrates an enlarged sectional view when an angle-fixed according to the rotation of the content case;

FIG. 31 illustrates a perspective view of a compact container according to still another embodiment of the present invention;

FIGS. 32 through 34 illustrates operational view of the compact container shown in FIG. 31;

FIG. 35 illustrates an exploded prospective view of the compact container shown FIG. 31;

FIG. 36 illustrates a sectional view along J-J line shown in FIG. 31;

FIG. 37 illustrates a sectional view along K-K line shown in FIG. 31;

FIG. 38 illustrates a sectional view along L-L line shown in FIG. 31;

FIG. 39 illustrates a sectional view along M-M line shown in FIG. 31;

FIG. 40 illustrates an operational view of an angle fixing unit of the compact container shown in FIG. 31 showing an enlarged sectional view when angle-fixed according to the rotation of the content case;

FIG. 41 illustrates an operational view with friction between a guide projection and an auxiliary piece of the compact container shown in FIG. 31;

FIG. 42 illustrates a perspective view of a compact container according to still another embodiment;

FIG. 43 illustrates a working state of the compact container shown in FIG. 42;

FIG. 44 illustrates a disassembled perspective view of the compact container shown FIG. 42;

FIG. 45 illustrates a bottom perspective view of the compact container shown in FIG. 42;

FIG. 46 illustrates a sectional view along N-N line shown in FIG. 42;

FIG. 47 illustrates a developed state of FIG. 42;

FIG. 48 illustrates a sectional view along O-O line shown in FIG. 42; and FIG. 49 illustrates a sectional view along P-P line shown in FIG. 42.

DESCRIPTION OF NUMERALS IN DRAWINGS

10; content case 11; makeup material
113; upper guide projection 114; lower guide projection
115: guide projection 12,122; guide groove
13: padding unit 14: hooking unit
15: hooking groove 16: guide roller
17: hooking unit 20: external case
20*a*, 20*d*: upper case 20*b*, 20*c*: lower case
20*c*: outer frame body 21: mirror
22,222: guide projection 223: upper guide groove
224: lower guide groove 224*a*: rotating unit
224*b*: fixed projection 225; rotation settling groove
23: hooking groove 24: hooking unit
25: guide rail 26, 27: hooking groove
30: puff 40: middle case
50: sliding auxiliary unit 51: sliding auxiliary piece
52: curved guide piece 53: hooking unit
54: finishing fixed piece 55; bending unit Mode for the Invention Embodiment #1

FIGS. 1 through 7 illustrates a compact container according to an embodiment of the present invention. The compact container includes a content case for containing makeup materials where guide grooves 12 are formed on its both sides and padding units 13 are formed on lower portions of its rear ends. The guide grooves 12 of the content case 10 are formed along the lengthy direction of the content case 10 with their ends curbed upward so that the external case 20 is set to stand with a predetermined angle (e.g. 10°~50°).

The external case 20 has a mirror 21 attached to the top side of it, cube shaped guide projections 22 which are fitted to the guide grooves 12 on its both inner sides. The external case 20 has an opened side for inserting/ejecting the content case 10 in a sliding manner and closed others for preventing the makeup materials from hardening, The content case 10 is inserted into the external case 20. When using the compact container, the content case 10 is converted from states as shown in FIGS. 1 and 5 into states as shown in FIGS. 3 and 6 respectively as the content case 10 is drew out from the external case 20 by hands, and eventually converted into states as shown in FIGS. 4 and 7 respectively if further drew out.

Described in detail, when the stat as shown in FIG. 1 is converted into the state as shown in FIG. 3 as the content case 10 is drew out from the external case 20, the content case 10 is slid while maintaining a horizontal state since the guide projections 22 are fitted to the guide grooves 12 of the content case 10. If the external case 20 is drew out further after that, the guide projections 22 are moved upward along upwardly-curved parts of the guide grooves 12 of the content case 10 so that the external case 20 is set to stand with a predetermined angle as shown in FIGS. 4 and 7, and thus user can put on her face while looking at the mirror 21 by using a puff 30 and the makeup material 11 as like using a makeup stand.

When intending to close and keep the compact container according to the present invention after finishing her makeup in the state when the external case 20 is set to stand with a predetermined angle with respect to the content case 10 as shown in FIGS. 4 and 7 respectively, the compact container can be closed by pushing both of the content case 10 and the external case 20 mutually in a reverse operation of the aforementioned operation as shown in FIG. 1.

It is preferable that circumferential edges of each of the guide projections 22 are fitted to upper and bottom parts of the guide grooves 12 respectively, thereby the external case 20 cannot be slid to be converted into the state as shown FIG. 6 by its own weight unless user applies an amount of external force (pressing force) to the external case 20. For this purpose, it is preferable that the lengths in crosswise direction of the cubic guide projections 22 are formed to be suitable to the distance of the guide grooves 12 of the content case 10. And further it is preferable that the padding units 13 on lower portion in rear end the content case 10 becomes to be contacted to the inner bottom side of the external case 20.

As described above, the compact container according to the embodiment of the present invention shown in FIGS. 1 through 7 can allow user to look at her face's reflection in any time by using the mirror 21 attached to the external surface of the compact container, needless to take a separate mirror with her. And further the compact container can allow user to makeup her face while looking at the mirror 21 by drawing out the content case 10 from the external case 20 in a mutual sliding manner to stand the external case 20 with a predetermined angle with respect to the content case 10.

Embodiment #2

FIGS. 8 and 9 illustrates a compact container according to another embodiment of the present invention. A detailed description will be omitted because the compact container is the same as the aforementioned embodiment #1 except to employ circular guide projections 22 in substitute for the cubic guide projections 22.

Embodiment #3

FIG. 10 illustrates a compact container according to still another embodiment of the present invention. A detailed description will be omitted because it is the same as the aforementioned embodiment #1 except that circular guide projections 222 are employed in substitute for the cubic guide projections 22 and the guide grooves 22 are formed in a straight line along a lengthy direction of the content case 10. However, the external case 20 of this embodiment is set to stand with a predetermined angle with respect to the content case 10 after drawing out the content case 10 from the external case 20 in a sliding manner as well as other embodiments.

Compact container of other embodiment shown in FIGS. 8 through 10 fixes the external case 20 with a predetermined angle using friction force between the guide projections 22 and the guide grooves 12 and 122 when setting to stand the external case 20 with a predetermined angle with respect to the content case 10 after drawing out the content case 10 from the external case 20 in a sliding manner. Unfortunately, there is a problem that user cannot makeup while looking at the mirror 21 because the external case 20 having been set to stand easily comes down when the guide projections 222 are worn away or when any force is applied on the external case 20. To solve such a problem, an improved compact container is suggested with improvement in the angle fixing means of the external case 20 and a sliding means of the content case 10 taken into the accompanied drawings behind FIG. 11.

Embodiment #4

FIGS. 11 through 20 illustrates a compact container according to still another embodiment of the present. The compact container includes the external case 20 where a mirror 21 is attached to its top side and the content case that can be inserted into and ejected from the external case 20, The external case 20 is comprised of an upper case 20*a* and a lower case 20*b*. The upper case 20*a* has the mirror 21 attached to its top side and is configured to form an opened lower portion. The lower case 20*b* is inserted from a side of the upper case 20*a* so as to be located in the upper case 20*a*. The lower case 20*b* has guide projections 222 formed in projection from its both sides and is configured to form an opened upper portion.

The content case 10, where guide grooves 112 are formed on its both sides, the padding units 13 with oblique angle is formed on the lower portion of its rear end and a middle case 40 for containing the makeup material 11 is hinge-connected to its upper portion, is inserted into the external case 20.

The guide projections 222 are to be slid in the guide grooves 112 of the content case 10. In order to stand the external case 20 with a predetermined angle as the content case 10 is drew out from the external case 20, the padding units 13 with oblique angle becomes to contact to the internal lower side of the external case 20 to prevent the external case 20 from standing any further. In order to fix the external case 20 after standing, hooking grooves 23 are formed in the entrance of the upper case 20*a* of the external case 20 and hooking units 14 are formed in upper potion of the rear side of the content case 10. The hooking units 14 are fitted to the hooking grooves 23 so that the external case 20 is angle-fixed, An operation of the compact container according to still another embodiment of the present invention will be described in detail taken with the accompanied drawings.

In the compact container according to still another embodiment of the present invention, the upper case 20*a* and the lower case 20*b* are fitted together to form the external case 20, the content case 10 is inserted and ejected within the inner room of the external case 20. The outer sides of the lower case 20*b* are received in the inner sides of the upper case 20*a*.

In other words, user can use a mirror swiftly and handily needless to open the compact container or needless to take a separate mirror since the mirror 21 is formed on the top side of the upper case 20*a*.

The lower case 20*b* is received in the upper case 20*a* by pushing in order to assemble the lower case 20*b*, whose upper portion is opened, from one side of the upper case 20*a*. The lower portion of the loser case 20*b* takes a role to cover the opened lower portion of the upper case 20*a* and the upper portion of the upper case 20*a* takes a role to cover the opened upper portion of the lower case 20*b*, thereby the external case 20 having a room provided by an inter connection of the upper case 20*a* and the lower case 20*b* is completed.

Such an internal room allows the content case to be received and to be slid freely. Because the guide grooves 112 are formed along a sliding direction on the both sides of the content case 10 and the guide projections 222 are formed in projection on the inner sides of the lower case 20*b* of the external case 20 so as to be fitted to the guide groove 112, the content case 10 can be slid back and forth along the guide grooves 112 without fluctuation in up and down direction.

As described above, because the external case 20 is set to stand with a predetermined angle, user can easily put on her face after drawing out the content case 10 from the external case by a sliding structure. Here, if the external case 20 rotates to stand, a rotating units 13 becomes to contact to the lower side of the lower case 20*b* of the external case 20, and thereby the rotation of the external case 20 is blocked. At this time, the predetermined angle between the external case 20 and the content case 10 can be maintained because the hooking units 14 are fitted to the hooking grooves 23 of the upper case 20*a*. Such a fitting operation can provide not only a role of fixing an angle of the rotated external case 20 but also a sense by which user can feel an angle-fixed state of the rotated external case 20.

In this angle-fixed state, user can put on her face with the puff 30, taken out from the lower room with the middle case 40 lifted out, and the makeup material 11 contained in the middle case 40.

Embodiment #4

FIGS. 21 through 30 illustrates a compact container according to still another embodiment of the present invention. The compact container includes the external case 20 where a mirror 21 is formed on its top side and the content case 10 which is inserted and ejected in a side of the external case 20, The external case 20 is formed by assembling an upper case 20*d* and a lower case 20*e* with an outer frame body 20*c*. The upper case 20*d* has the mirror 21 formed on its top side, the lower case 20*e* has lower guide grooves 224 on its both inner sides, and the outer frame body 20*c* is formed in the form of character and binds firmly the upper case 20*d* and the lower case 20*e* without any gap.

The content case 10 has upper guide projections 113 and lower guide projections 114, which are inserted to slide into the upper guide grooves 223 and the lower guide grooves 224 correspondingly, on its both rear sides respectively.

Here, perpendicular cutting holes are formed on the both ends of the upper guide projections 113 and the lower guide projections 114 so that the upper guide projection 113 and the lower guide projection 114 are made to be elastic. Thus it is easier to assemble the content case 10 with the upper 20*d* and the lower case 20*e*.

The rotating unit 224*a*, which is curved upward at the end of the lower guide grooves 224 of the lower case 20*e*, makes the content case 10 and the external case 20 can be placed with a predetermined angle as the lower guide projections 114 rotate in the lower guide grooves 224. Where, fixed projections 224*b* are formed so as to prevent the lower guide projections 114 located in the rotating unit 224 from fluctuating.

Further, in order to fix the external case 20 with a predetermined angle with respect to the content case 10, hooking units 24 formed on the both sides of entrance of the upper case 20*d* and corresponding hooking grooves 15 formed on the both sides of the content case 10 are provided. The hooking units 24 are fitted to the hooking units so that the external case 20 and the content case 10 can be fixed to maintain a predetermined angle.

An operation of the compact container as described above will be described in detail taken into accompanied drawings as follows.

The compact container according to the still another embodiment of the present invention has a structure that the upper case 20*d* and the lower case 20*e* separated from each other are assembled by the separate outer frame body 20*c* to form the external case 20 and the content case 10 is inserted and ejected in the one side of the external case 20 in a sliding manner.

Because the upper case 20*d* has the upper guide grooves 223 formed on its inner sides and the lower case 20*e* has the lower guide grooves 224 formed on its inner sides, the content case 10 can be inserted and ejected with the upper guide projections 113 and the lower guide projections 114 formed on both ends of the content case 10 inserted into the upper guide grooves 223 and the lower guide grooves respectively.

The lower guide grooves 224 formed on the both inner sides of the lower case 20*e* allows the external case 20 to rotate so that the external case 20 can stand by the rotating units 224*a* formed on its ends. The lower guide projections 114 are induced to an upward direction near to the rotating units 224 and it rotates about the upper guide projections 113 as an axis. By such an operation, the external case 20 rotates to stand with a predetermined angle with respect to the content case 10, and thus user can put on her face while looking at the mirror 21 formed on the tip side of the upper case 20*d*.

It is possible to maintain the oblique angle of the external case 20 because the fixed projections 224*b* formed on the rotating units 224 prevent the lower guide projections 114 located in the rotating unit 224 from rotating as the external case 20 is rotated with respect to the content case 10 by the rotating units 224 of the lower guide grooves 224. Further in order to maintain the angle of the external case 20 more stably, the hooking units 24 formed on the ends of the inner sides of the upper case 20*d* and the hooking grooves 15 for being fitted to the hooking units 24 formed on the ends of the both sides of the content case 10 are provided.

The hooking units 24 and the hooking grooves 15 are formed in the locations where the upper case 20*d* and the content case 10 is faced with each other when the external case 20 is rotated with respect to the content case 10. By fitting them together, the angle between the external case 20 and the content case 10 is maintained. Further because user can feel the fitting force of the hooking units 24 and the hooking grooves 15, the user can recognize the state when the external case 20 is fixed with the predetermined angle.

Because a room where the puff 30 can be contained is formed in the bottom portion of the middle case 40, user can makeup by taking out the puff 30 with the middle case 40 opened and touching the makeup material 11 in the middle case 40 when intending to makeup.

The compact container becomes to be a state for carrying and keeping by inserting the content case 10 into the external case 20 after the external case 20 and the content case 10 are arranged in a straight line by pressing the external case 20 downward.

Embodiment #6

FIGS. 31 through 41 illustrates a compact container according to still another embodiment of the present invention. The compact container includes the external case 20 where the mirror 21 is attached to its top side and the content case 10 which is inserted and ejected in a side of the external case 20 in a sliding manner, Separate sliding auxiliary units 50 are disposed between the external case 20 and the content case 10 so that the content case 10 can be inserted and ejected along the slide auxiliary unit 50 in a sliding manner. Here, the slide auxiliary units have slide auxiliary pieces 51 on both sides.

The external case 20 has the mirror 21 formed on its top side, the guide rails 25 formed in both bottom portions of its inner sides and the hooking grooves 26 with a shape of an under-cut on the ends of its inner sides.

The content case 10 has guide projections 115 formed on the both ends, the padding units 13 with a predetermined angle formed in the rear bottom potions of the guide projections 115. The middle case 40 where the makeup material 11 is received is hinge-connected on the upper portion of the content case 10 and the puff 30 is kept in the lower portion of the middle case 40.

The slide auxiliary units 50 have slide auxiliary pieces 51 formed on its both sides, curbed guide pieces 52 formed on the ends of the slide auxiliary pieces 51, hooking units 53 with a shape of under-cut in protruding manner on both sides of the slide auxiliary pieces 51, and finishing fixed pieces 54 formed on the ends of the slide auxiliary pieces 51.

The operation of the compact container according to still another embodiment of the present invention will be described in detail taken into the accompanied drawings as follows.

The hooking units 53 formed on the slide auxiliary pieces 52 of the slide auxiliary units 50 and the corresponding hooking grooves 26 formed on the ends of the inner sides of the external case 20 are undercut-connected firmly when assembling the external case 20 and the slide auxiliary units 50 so that the slide auxiliary units 50 cannot be separated from the external case 20 or fluctuated even though the content case 10 is operated to insert or eject in a sliding manner.

The content case 10 is slid within the inner space of the slide auxiliary units 50 for inserting or ejecting in the one side of the external case 20. The guide projections 115 are protruded on the ends of the both rear sides of the content case 10. A top sides of the guide projections 115 contact to bottom sides of the curved guide pieces 52 of the slide auxiliary units 50 and bottom sides of the guide projections 115 contact to the guide rails 25 formed in the bottom portions of the inner sides of the external case 20, so that the guide projections 115 can be inserted and ejected stably and with sliding without fluctuation.

When user ejected the content case 10 from the external case 20 using the sliding inserting/ejecting structure, the content case 10 can be easily ejected in the stably supported state by the slide auxiliary units 50 and the guide rails 25 as shown in FIG. 37. When user inserted the content case 10 into the external case 20 again, the external case 20 and the content case 10 are assembled as shown in FIG. 36.

When the content case 10 is ejected from the external case 20 as shown in FIG. 37, user sets to stand the external case 20 by rotating it upwardly so that user can makeup. If user gives a lift of the external case 20 with one hand while holding the content case 10 in the other hand, the external case 20 is stop with an oblique angle by the operation of the padding units 13 formed on the ends of the content case 10 as shown in FIG. 38. That is, the content case 10 is rotated about the guide projections 115 of the content case 10 as shown in FIG. 40, and the rotation of the external case 20 is stop with an angle proper to makeup as the guide rails 25 become to contact to the padding units 13 of the external case 20, The reason the external case 20 is maintained with an oblique angle is that the padding units 13 becomes to have a fixing force because the angle of boundary line rotates about and goes over the guide rails 25 with the guide rail 25 slightly pressed as the content case 10 rotates. Thus, the external case 20 can be fixed with an oblique angle with respect to the content case 10 unless the external case 20 is pushed down with artificial force.

Bending units 55 with a sufficient curvature may be formed on the slide auxiliary pieces 51 of the slide auxiliary units 50. If the bending units 55 are provided, it is possible to provide a rhythmical inserting/ejecting because friction force with the guide projections 115 moving while contacting to the slide auxiliary pieces 51 varies according to location. That is, the bending units 55 formed in the middle portions of the slide auxiliary pieces 51 have a maximum friction force when the content case 10 is inserted into the slide auxiliary units 50 completely. The friction force decreases gradually as the content case 10 ejected outward, so that ejection can be done easily. When the content case 10 is ejected as much as half the length, the friction force increases. As the ejection is mostly completed, the friction force restores the maximum value and thereby the ejection is finished naturally.

The reason why the friction force can be varied according to location in the inserting/ejecting section of the content case 10 is configured to perform a rhythmical and smooth inserting/ejecting operation for adapting to the sensitive feeling of woman in consideration that most customers are women and for providing a graceful image with superior sense of usage.

User can makeup using the makeup material 11 in the middle case 40 formed in the upper portion of the content case 10 when the content case 10 is ejected as shown in FIG. 34. And user can makeup easily because use can look at the mirror 21 formed on the top side of the external case 20. Further user can use the puff 30 received in the lower portion of the middle case 40 which is assembled to the upper portion of the content case 10 in a rotating manner Embodiment #7

FIGS. 42 through 49 illustrates a compact container according to still another embodiment of the present invention. The compact container includes the external case where the mirror 21 is attached to its top side and the content case 10 which is inserted and ejected in the one side of the external case 20.

The compact container has a pare of guide grooves on the both inner sides of the content case 10 as well as the embodiment #5 and has a feature that it has guide projections and a pare of guide rollers in place of two guide projections on the ends of the both sides of the content case 10.

The external case 20 has the mirror 21 formed on its top side, an upper guide grooves 223 and lower guide grooves 224 on the both inner sides of it respectively. A rotation settling grooves 225 are formed on the ends of the upper lower guide grooves 223 and 224, and hooking grooves 27 are formed on the bottom side of the entrance of the external case 20.

The upper guide projections 113 are formed with projection on the ends of the both sides of the content case 10, a pare of guide rollers 16 are formed beneath of the upper guide projections 113, hooking units 17 which are fitted to the hooking grooves of the external case 20 on the bottom side of the content case 10, and the padding units 13 are formed on the ends of the bottom side of the content case 10.

The operation of the compact container as described above will be described in detail taken into the accompanied drawings as follows.

The compact container includes guide grooves and guide rollers suitable to insert and eject the content case 10 into and from the external case 20 respectively in a sliding manner. That is, the upper guide projections 113 of the content case 10 are inserted into the inner upper guide grooves 223 of the external case 20 and the pare of the guide rollers 16 are formed into the lower guide grooves 224 of the external case 20. Thus, the content case 10 can be stably inserted and ejected into or from the external case in a sliding manner without fluctuation. It is possible to provide a smooth and simple sliding operation because the guide rollers 16 reduce a resistance of friction dramatically.

In the compact container according to the embodiment of the present invention, the external case 20 is set to stand with a predetermined angle with respect to the content case 10 so that makeup can be done easily as well as other embodiment. Because the padding units 13 in the lower portions of the ends of the content case 10 contact to the inner bottom side of the external case 20 as shown in FIG. 48 and the hooking units of the content case 10 are fitted to the hooking grooves 27 of the external case 20, the angle between the external case 20 and the content case 10 can be fixed.

Industrial Applicability

While the present invention has been particularly shown and described with reference to exemplary embodiments thereof, it will be understood by those of ordinary skill in the art that various changes in form and details may be made therein without departing from the spirit and scope of the present invention as defined by the following claims.

The invention claimed is:

1. A cosmetic container comprising:

an external case having a top and bottom face, two opposing side faces, a rear face and an open front side forming an inner portion;

guide rails formed on opposing sides of the bottom face in the inner portion;

hooking grooves located on opposing side faces of the inner portion;

a contents case for containing makeup materials and configured to be inserted into and ejected out of the external case in a sliding manner; the contents case comprising:

two opposing lateral faces, opposing top and bottom faces and opposing front and rear faces;

guide projections located on a rear side of the opposing lateral faces;

a padding unit formed on a rear side of the bottom face of the contents case, where the padding unit form an oblique angle on the rear side of the contents case configured to make contact with an internal lower side of the external case in order to cause the external case to stand at a non 180 degree angle with respect to the contents case after the contents case has been ejected from the external case;

a slide auxiliary unit configured to be attached to the inside of the external case, the slide auxiliary unit comprising:

two opposing slide auxiliary pieces, each slide auxiliary piece comprising:

a hooking unit configured to attach to complimentary hooking grooves attached to the inside of the external case;

a curved guide piece that extends from a bottom face of each slide auxiliary piece and extends the length of the slide auxiliary piece and;

wherein the contents case is inserted and ejected from the external case while a top and bottom surface of the guide projections of the content case are slid between the guide rails of the external case and the slide auxiliary pieces of the slide auxiliary units;

wherein the friction force varies according to the location of the guide projection on the curved portion of the slide auxiliary pieces.

2. The compact container of claim 1, further comprising: a mirror formed on the top face of the external case.

* * * * *